US006115574A

United States Patent [19]

Mikuriya

[11] Patent Number: 6,115,574

[45] Date of Patent: Sep. 5, 2000

[54] IMAGE-FORMING METHOD

[75] Inventor: Yushi Mikuriya, Numazu, Japan

[73] Assignee: Canon Kabushiki Kaisha, Tokyo, Japan

[21] Appl. No.: 09/166,591

[22] Filed: Oct. 6, 1998

[30] Foreign Application Priority Data

Oct. 7, 1997 [JP] Japan ..... 9-290297

[51] Int. Cl.[7] ..... G03G 15/08

[52] U.S. Cl. ..... 399/258; 399/260; 399/263; 399/272; 399/274; 399/359

[58] Field of Search ..... 399/358, 359, 399/258, 262, 272, 273, 274, 275, 119, 360, 260, 263

[56] References Cited

U.S. PATENT DOCUMENTS 4,370,049 1/1983 Kuge et al. ..... 399/272
5,493,382 2/1996 Takagaki et al. ..... 399/359
5,604,575 2/1997 Takagaki et al. ..... 399/359
5,737,680 4/1998 Takagaki et al. ..... 399/359
5,832,350 11/1998 Kumasaka et al. ..... 399/272 X
5,848,343 12/1998 Takahashi et al. ..... 399/359

*Primary Examiner*—Matthew S. Smith
*Attorney, Agent, or Firm*—Fitzpatrick, Cella, Harper & Scinto

[57] ABSTRACT

An image-forming method uses an assembly having a first toner replenishing hopper, a toner storage room, a nonmagnetic cylindrical rotating member provided with a first mixed magnetic field-generating device, a first magnetic blade, a nonmagnetic cylindrical development sleeve provided with a second fixed magnetic field generating device, a second magnetic blade, an electrostatic image holding member, a cleaning device and a second toner-replenishing hopper. At least certain of the foregoing components are set to have specific positional relationships with one another so that the recovered magnetic toner is efficiently reused together with the fresh magnetic toner.

36 Claims, 11 Drawing Sheets

IMAGE-FORMING METHOD

BACKGROUND OF THE INVENTION

1. Field of the Invention

The present invention relates to an image-forming method using electrophotography or electrostatic recording, which has a process in which recovered toner is reused.

2. Related Background Art

Image-forming methods have been known in which an electrophotographic system or an electrostatic recording system is utilized. Various methods are disclosed, for example, in U.S. Pat. 2,297,691, Japanese Patent Publication Nos. 42-23910 and 43-24748. Generally in these methods, an electrostatic image is formed on a photosensitive member (electrostatic image holding member) constituted of a photoconductive material, the formed electrostatic image is developed with a toner, the developed toner image is transferred onto a recording medium like a paper sheet, and the transferred toner image is fixed by heating, pressing, heat-pressing, or solvent-vapor treatment.

In recent years, on laser beam printers (LBP) and copying machines employing the electrophotographic system, various requirements are imposed, such as digitization and toner particle size reduction for the purpose of realizing higher-speed printing and higher quality images, employment of an on-demand fixing system for energy saving, and reuse of waste toner (recovered toner) to meet environmental problems.

However, in meeting these requirements, various disadvantages are caused. For example, finer toner has a larger surface area per unit weight, having broader distribution of electric charge to render the toner chargeability sensitive to environmental variations. In particular, a finer particulate toner, when stored for a long period of time under high temperature and high humidity, tends to be affected by moisture to have a lower charging capacity, resulting in a lower developed image density, and toner scattering. On the other hand, under low humidity conditions, the finer toner tends to be charged excessively to cause fogging, image density drop, and sleeve ghost.

Digital copying machines are required to be capable of reproducing a letter-containing photographic image with sharpness of the reproduced letters and precise density gradation of the photograph. Generally, in reproducing a letter-containing photographic image, increase of line density for sharpness of reproduced letters impairs the density gradation of the photographic image and roughens the half-tone portion of the image. On the other hand, increase of density gradation of the image lowers the line density to impair the sharpness of the image.

In recent years, the density gradation of the copied image has become improved to some extent by digitization of the image density signal. However, further improvement is demanded. The image density is not in linear relation with the development potential (difference in the potentials between the photosensitive member and the developer holder): the curve is convexed downward at the lower development potential portion, and the curve is convexed upward at the higher development potential portion owing mainly to the characteristics of the developing agent. Therefore, at the half tone portion, slight variation in the development potential greatly changes the image density to render the density gradation unsatisfactory.

Reproduction of a line image is usually affected by the edge effect. Therefore, in the line image reproduction, the maximum density of 1.30 is sufficient at a solid image area which is less liable to be affected by the edge effect in order to keep the sharpness of the line image. On the other hand, reproduction density of a photographic image is affected greatly by surface gloss of the photograph itself, and the maximum image density is as high as 1.90 to 2.00. In the photograph image reproduction, even if the surface gloss of the photograph is reduced, the improvement of the density by the edge effect is not achievable because of the large area of the image. Therefore, in the photograph image reproduction, the maximum density ranging from 1.4 to 1.5 is necessary at a solid image area. Accordingly, it is very important to keep the maximum image density in the range from 1.4 to 1.5 for reproduction of a letter-containing photograph.

Furthermore, in the digital copying machine employing a reversal development system, the toner is moved by an electric field to a non-charged region or to a region of the same polarity and retained on the surface of the photosensitive member by the electric field generated by electrostatic induction of the toner. Therefore, in order for the toner to be transmitted while securely held on the photosensitive member, the toner chargeability should be increased so as to cause the electrostatic induction.

When the toner image is transferred, a recording medium (paper, etc.) for receiving the transferred toner image is charged electrically to the polarity opposite to that of the photosensitive member. The higher intensity of current for the transfer tends to cause problems such as winding of the recording medium by the photosensitive member by electric attraction, and re-transfer of the transferred toner to the photosensitive member. Therefore, the transfer current intensity is inevitably limited, and the electric charge of the toner should be increased to raise the releasability of the toner from the photosensitive member so as not to lower the transfer efficiency even in a weak electric field.

In a high-speed copying machine in which the photosensitive drum or photosensitive belt is rotated at a higher speed, the development sleeve or the developer holding member should also be driven at a higher speed correspondingly. However, an excessively high speed of the development sleeve can cause a fluidity-improving agent to drop out of toner particles or to be embedded into the toner particles owing to the temperature rise of the main body of the copying machine and friction with the developing agent. Such a deteriorated toner may not be charged suitably, resulting in a lower development efficiency, and is liable to cause the drop of image density when used for a long period of time. The insufficient toner charge lowers the toner transfer efficiency to decrease the density of the transferred image, or weakens the toner-confining force of the transferring electric field to cause scattering of toner particles and deterioration of image quality.

The on-demand fixing system intends energy saving. This system applies electric power only when the fixing is conducted for copying, without applying the power while the copying machine is stopping. In another fixing system, quick-start fixing is practicable in which the copying is conducted immediately after the turning-on of the copying machine without waiting time. In this system, fixing is conducted by heating and pressing by applying heat from a heater through a heat-conductive film to the toner on a recording medium instead of employing a heating roller (surf fixing).

In the surf fixing, however, owing to the low heat capacity of the film, the temperature of the portion of the delivered recording medium rushing to the film is lower than that of the portion of the film of heat-and-pressure fixing. Therefore, the toner particles in an nearly unmelted state on the recording medium rush to the film, which can bring about image defects of fixing scattering caused by a delicate air flow at the rushing portion of the recording medium to the film or by a electrostatic force acting between the toner particles and the film. This phenomenon is more remarkable in higher speed copying. This phenomenon of the fixing scattering can be prevented by development with a highly charged toner to form a toner image on a photosensitive member and transferring the toner image onto a recording medium to form an image in which toner particles are densely held.

The reuse of the toner recovered from the photosensitive member in the cleaning step is another problem arising in the system from the standpoint of environmental protection. After transfer of a developed toner image from a photosensitive member onto a recording medium, the toner remains partially on the photosensitive member. Conventionally, the remaining toner is recovered by a blade, a fur brush, a magnetic brush, or the like from the photosensitive member, and is stored in the main body of an image-forming apparatus. The recovered toner is finally discarded.

From the standpoint of environmental protection, copying machines are proposed which have a reuse system for reusing a remaining toner after image transfer for image development as a mixture with a fresh toner. However, the toner remaining after image transfer is inferior to the fresh toner in fluidity and chargeability, and can cause aggregate and charging failure to occur, resulting in image defects. A simple mixture of a remaining toner and a fresh toner can cause problems in image formation.

To solve technically the problems in the reuse system, Japanese Patent Application Laid-Open Nos. 2-157765, and 6-59501 (corresponding to EP-A573933) disclose control of particle size distribution of the toner to be used. Further improvement of the reuse system is demanded. For example, a high-speed copying machine (or a high-speed printer), which conducts a large number of copying operations such as copying of 60 or more A4-size recording paper sheets, recovers a large amount of unused toner from an electrostatic image holding member (e.g., photosensitive drum or photosensitive belt) in a cleaning step after image transfer in comparison with a low- or medium-speed copying machine. The recovered toner has a low fluidity, tending to form aggregate. Even with the proposed reuse system, the aggregatable recovered toner is not readily reusable without lowering the image quality in the high-speed copying machine in comparison with the reuse in the low- or medium-speed copying machine. In particular, a one-component magnetic toner as the developing agent is more difficult to reuse than a two-component developing agent composed of a nonmagnetic toner and a magnetic toner.

For the stabilization of the toner chargeability, various developing agent constitutions and development devices are disclosed. For example, Japanese Patent Application Laid-Open No. 9-26699 discloses an arrangement of a development sleeve and an auxiliary development sleeve close to a photosensitive drum to prevent a development ghost and toner deterioration. This is effective to some extent in preventing the development ghost and the toner deterioration. With this arrangement, however, a fine particulate toner having a large specific surface area may not readily be frictionally charged uniformly since the frictional charge is applied to the toner only by the development sleeve and a control blade. Further, for the formation of images having various image ratios with uniformly high image density, a member is necessary in which a toner is uniformly fed in the lengthwise direction of the development sleeve in a development device.

In a development device of a toner-replenishing type, differently from a cartridge type one used in LBP, the toner held in the device, the replenished toner, and the recovered toner are different from each other in fluidity and chargeability, and therefore the respective toners should be mixed sufficiently by stirring before use for the development. The toner mixed insufficiently, when applied onto a development sleeve, has a broad charge distribution, and may produce toner particles charged in opposite polarity. The oppositely charged toner particles are liable to adhere to the white blank portion of the image to cause reversed fogging.

SUMMARY OF THE INVENTION

An object of the present invention is to provide an image-forming method which efficiently reuses a recovered magnetic toner from electrostatic image holding member in a cleaning step.

Another object of the present invention is to provide an image-forming method which employs a reuse system for satisfactorily reusing a recovered magnetic toner at a high process speed.

Still another object of the present invention is to provide an image-forming method which enables a toner image to be formed even by the combined use of a recovered magnetic toner and a replenished magnetic toner with a high image quality, and gives durability of the toner in many sheets of copying.

A further object of the present invention is to provide an image-forming method which enables a combination of a recovered magnetic toner and a replenished magnetic toner to be applied to, or to be satisfactorily scraped from, a development sleeve.

A still further object of the present invention is to provide an image-forming method which enables sufficient mixing of a combination of a recovered magnetic toner and a replenished fresh toner to be sufficiently mixed by stirring, and can satisfactorily effect frictional electric charging of the magnetic toner.

Yet another object of the present invention is to provide an image-forming method which is capable of forming an image of a high quality under various environmental conditions even with a combination of a recovered magnetic toner and a replenished magnetic toner. The image-forming method of the present invention comprises replenishing a magnetic toner through a first toner-replenishing hopper to a toner storage room, introducing the replenished magnetic toner from the toner storage room onto a nonmagnetic cylindrical rotating member having a first fixed magnetic field-generating means enclosed therein, delivering the magnetic toner by rotation of the rotating member, through a gap $D_1$ between a first magnetic blade and the rotating member, to a nonmagnetic cylindrical development sleeve having a second fixed magnetic field-generating means enclosed therein, delivering the magnetic toner by rotation of the development sleeve through a gap $D_2$ between a second magnetic blade and the development sleeve to form a magnetic toner layer on the development sleeve, transferring the magnetic toner from the development sleeve onto an electrostatic image holding member to develop an electrostatic image on the electrostatic image holding member and to form a magnetic toner image, transferring the formed magnetic toner image onto a recording medium, recovering the magnetic toner remaining on the electrostatic image holding member after the transfer of the magnetic toner image by a cleaning means to obtain a recovered magnetic toner, and delivering the recovered magnetic toner to a second toner-replenishing hopper to feed the recovered magnetic toner to the toner storage room, wherein the first magnetic blade and the second magnetic blade are placed on the side opposite to the electrostatic image holding member relative to a vertical line $L_1$ passing through the center of the development sleeve, the center of the rotating member is placed on the vertical line $L_1$ or on the side opposite to the electrostatic image holding member relative to the vertical line $L_1$, an angle $\theta_1$ between the vertical line $L_1$ and a straight line $L_2$ connecting the center of the development sleeve and the center of the rotating member is more than 0° and less than 90°, an angle $\theta_2$ between the vertical line $L_1$ and a straight line $L_3$ connecting a point on the magnetic blade closest to the development sleeve and the center of the development sleeve is more than 0° and less than 80°, a gap $D_3$ between the surface of the rotating means and the development sleeve satisfies the following conditions:

$$D_1 \geqq D_3 > D_2$$

and the recovered toner is fed through the gap $D_1$ to the development sleeve and used to develop an electrostatic image.

DESCRIPTION OF THE PREFERRED EMBODIMENTS

The present invention relates to an image-forming method employing a one-component magnetic toner in which a magnetic toner recovered in a cleaning step from an electrostatic image holding member (e.g., photosensitive drum, and photosensitive belt) is introduced to a development device and is reused for development. In the image-forming method of the present invention, the development device employed in the development step is improved to uniformly apply the recovered magnetic toner more aggregatable than a fresh magnetic toner with the replenished fresh magnetic toner onto a development sleeve, enabling thereby many sheets of copying of magnetic toner images with high quality at a high process speed.

The image-forming method of the present invention is described specifically with reference to drawings.

Figure 1:
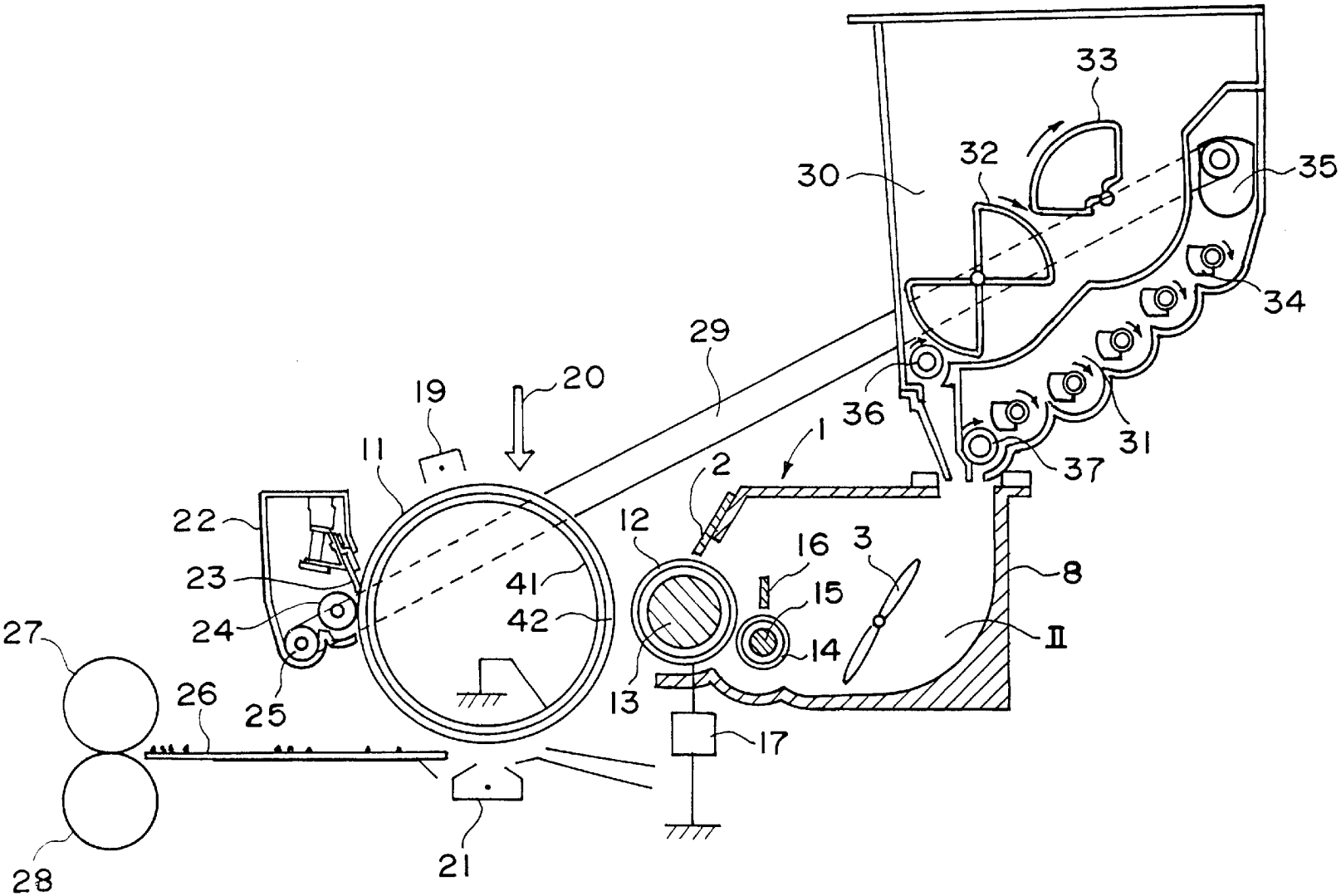
FIG. 1 is a schematic drawing for illustrating a specific example of practicing the image-forming method of the present invention.

FIG. 1 illustrates a specific example of the image-forming apparatus for practicing the image-forming method of the present invention. In the image-forming apparatus shown in FIG. 1, a fresh toner is fed successively to a toner storage room II of a toner vessel 8 of the development device 1 by rotation of a first magnet roller 36 through a first toner-replenishing hopper having a first stirrer 33 and a second stirrer 32. The fed magnetic toner is introduced by rotation of a fourth stirrer 3 to a nonmagnetic cylindrical rotating member 14 enclosing a first fixed magnet 15 which serves as a first magnetic field-generating means. The introduced magnetic toner is held on the surface of the rotating member 14 by the magnetic force of the first fixed magnet 15, and is delivered by rotation of a rotating member 14 toward a first magnetic blade 16.

Figure 2:
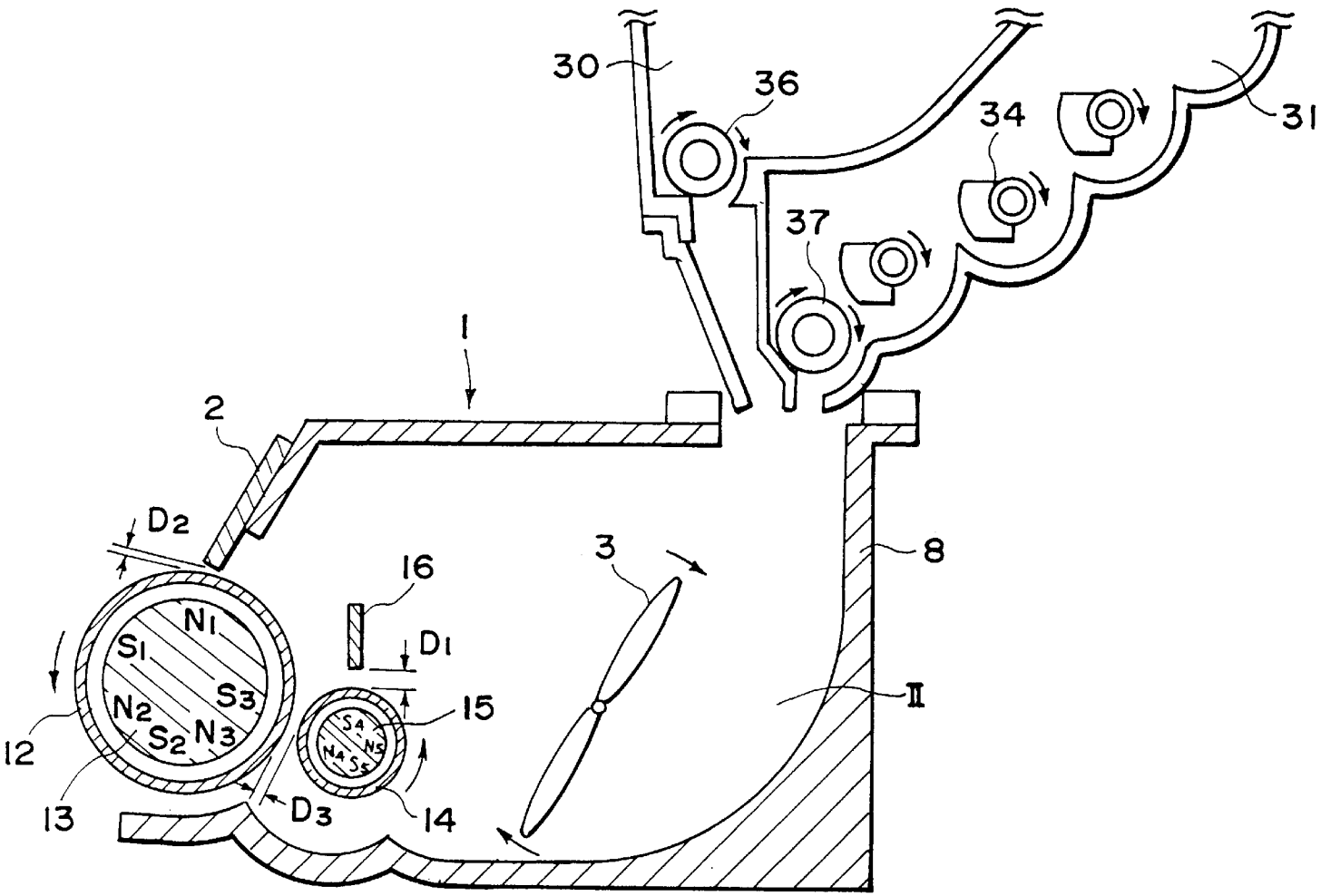
FIG. 2 is a schematic drawing of a development device of the present invention.

FIG. 2 is a partially enlarged view of the development device shown in FIG. 1. The magnetic toner delivered by rotation of the rotating member 14 is fed through a gap $D_1$ between a first magnetic blade 16 and the rotating member 14 to a development sleeve 12 enclosing a second fixed magnet 13 as a second magnetic field-generating means. The magnetic toner held on the surface of the rotating member 14 is allowed to pass through the magnetic force lines formed between the tip of the first magnetic blade 16 and the first fixed magnet 15, whereby the magnetic toner is applied more uniformly onto the surface of the rotating member 14, and is electrically charged by friction. The magnetic toner fed from the rotating member 14 to the development sleeve 12 is held on the surface of the development sleeve 12 by the magnetic force of the second fixed magnet, and is delivered by rotation of the development sleeve 12 toward a second magnetic blade 2.

The magnetic toner delivered with rotation of the development sleeve 12 is allowed to pass through the gap $D_2$ between the surface of the development sleeve 12 and the tip of a second magnetic blade 2 to the development region formed between a photosensitive drum 11 and the development sleeve 12. By passing through the gap $D_2$, the magnetic toner is formed into a layer of a prescribed thickness on the surface of the development sleeve 12. By passing through the magnetic lines formed between the tip of the second magnetic blade 2 and a second fixed magnet 13, the magnetic toner uniformly applied on the surface of the development sleeve 12, and is electrically charged additionally by friction.

A photosensitive drum 11 having an electroconductive substrate 41 and a photosensitive layer 42 is electrically charged at a prescribed voltage by a charging means (e.g., corona charger, charging roller, charging brush, charging blade, etc.) to which a voltage is applied from the outside. Imagewise exposing light 20 forms an electrostatic image on the photosensitive drum 11. The photosensitive layer 42 of the photosensitive drum 11 may be an organic photoconductive photosensitive layer (OPC), or an inorganic photosensitive layer, but is preferably an amorphous silicon photosensitive layer or a polycrystalline silicon photosensitive layer which can meet a high process speed and is excellent in durability resistant to many sheet copying.

The light exposure for forming the electrostatic image on the photosensitive drum 11 may be analog light exposure, or may be laser beam light for forming a digital electrostatic image. The electrostatic image formed on the photosensitive drum 11 may be either an analog electrostatic latent image or a digital electrostatic latent image.

The electrostatic image formed on the photosensitive drum 11 is developed to form a toner image on the photosensitive drum 11 by a normal development method or a reversal development method by transferring the frictionally charged magnetic toner from the development sleeve 12 to which a prescribed bias is applied by a bias applying means 17. The magnetic toner image on the photosensitive drum 11 is delivered with rotation of the photosensitive drum 11 to the site where a bias-applied transferring means 21 (e.g., corona charger, transfer roller, transfer belt, transfer blade, etc.), and is transferred onto a recording medium 26 (e.g., plain paper sheet, transparent film for OHP sheet, coated paper sheet, etc.). The magnetic toner image on the recording medium 26 is fixed by a heat-pressure fixing means on the recording medium. The heat-pressure fixing means has, for example, a heating roller 27 enclosing a heat-generating means, and a pressing roller 28.

A magnetic toner remaining on the surface of the photosensitive drum 11 after the toner image transfer is cleaned by a cleaning means 22. The cleaning means 22 has, for example, a cleaning blade 23, and a cleaning magnet roller 24 having magnetic particles (e.g., magnetic toner particles). The magnet roller 24 rotates to rub the surface of the photosensitive drum 11 with a magnetic brush formed on the magnet roller surface. The remaining magnetic toner which has not been cleaned off by the magnet roller 24 is cleaned by a cleaning blade 23. The toner which is recovered from the surface of the photosensitive drum 11 by the magnet brush of the magnet roller 24 and the cleaning blade 23 and is stored after repeating the steps of electrical charging, light exposure, development, image transfer, and cleaning. The recovered toner is sent successively by delivery screw 25 to a delivery pipe 29. The delivery pipe 29 is provided therein with a delivery screw or the like. The recovered magnetic toner is delivered with rotation of the delivery screw in the delivery pipe 29 from the cleaning means 22 through the delivery pipe 29 and an inlet opening 35 to a second toner-replenishing hopper 31.

The recovered toner introduced through the opening 35 to the rear side of the second toner-replenishing hopper 31 is sent downward with agitation by rotating third stirrers, and is distributed uniformly throughout from the back side to the front side of the second toner-replenishing hopper. Then the recovered magnetic toner in the second toner-replenishing hopper is fed with rotation of a second magnet roller 37 to the toner storage room II of the development vessel 8 in a prescribed ratio relative to the replenished magnetic toner fed from a first toner-replenishing hopper 30.

The ratio ($W_1/W_2$) of the feed $W_1$ by weight of the magnetic toner fed from the first toner-replenishing hopper to the feed $W_2$ by weight of the magnetic toner fed from the second toner-replenishing hopper affects partly the efficiency of transfer of the magnetic toner image onto the recording medium in the transfer step. For maintaining a satisfactory image quality, the ratio ranges preferably from 5 to 20, more preferably from 5 to 15. The feed weights $W_1$ and $W_2$ can be controlled by adjusting the rotation speed of the first magnet roller 36 and the second magnet roller 37. The recovered magnetic toner fed from the second toner-replenishing hopper to the toner storage room II is introduced to a rotating member 14 together with the magnetic toner fed from the first toner-replenishing hopper to the toner storage room II with rotation of a stirrer 3. The recovered magnetic toner, together with the other magnetic toner, is delivered toward the first magnetic blade 16, and is fed through the gap $D_1$ to the development sleeve 12. The recovered magnetic toner is more aggregatable than the fresh magnetic toner, and is liable to form aggregate during delivery from the cleaning means to the second toner-replenishing hopper. However, the aggregate, if it is formed, is pulverized during passage through the magnetic lines formed between the tip portion of the magnetic blade 16 and a first fixed magnet 15. Therefore, the magnetic toner is uniformly applied on the development sleeve even in the presence of the recovered magnetic toner.

The recovered magnetic toner fed onto the development sleeve 12 is delivered together with the other magnetic toner to the development region to develop the electrostatic image.

With the development device employed in the image-forming method of the present invention, the first magnetic blade 16, the rotating member 14, and the development sleeve 12 are placed so as to satisfy the conditions of $D_1 \geqq D_3 > D_2$ (preferably $D_1 > D_3 > D_2$) in order to keep high image quality for a long-term running by reusing a recovered magnetic toner effectively.

With a magnetic toner having an average particle diameter in the range from 2.0 to 10.0 $\mu$m, the gap $D_1$ ranges preferably from 1 to 6 mm (more preferably from 3 to 5 mm), the gap $D_2$ ranges preferably from 0.10 to 0.50 mm (more preferably from 0.15 to 0.40 mm), and the gap $D_3$ ranges preferably from 0.3 to 5 mm (more preferably from 0.7 to 2.9 mm) for keeping the high image quality in long-term running.

In the development device 1 employed in the image-forming method of the present invention, the first magnetic blade 16 and the second magnetic blade 2 are placed on the side opposite to the electrostatic image holding member (photosensitive drum 11) relative to a vertical line $L_1$ passing through the center of the development sleeve 12. The center of the rotating member 14 is placed on the vertical line $L_1$ or at the side opposite to the electrostatic image holding member relative to the vertical line $L_1$.

Figure 3:
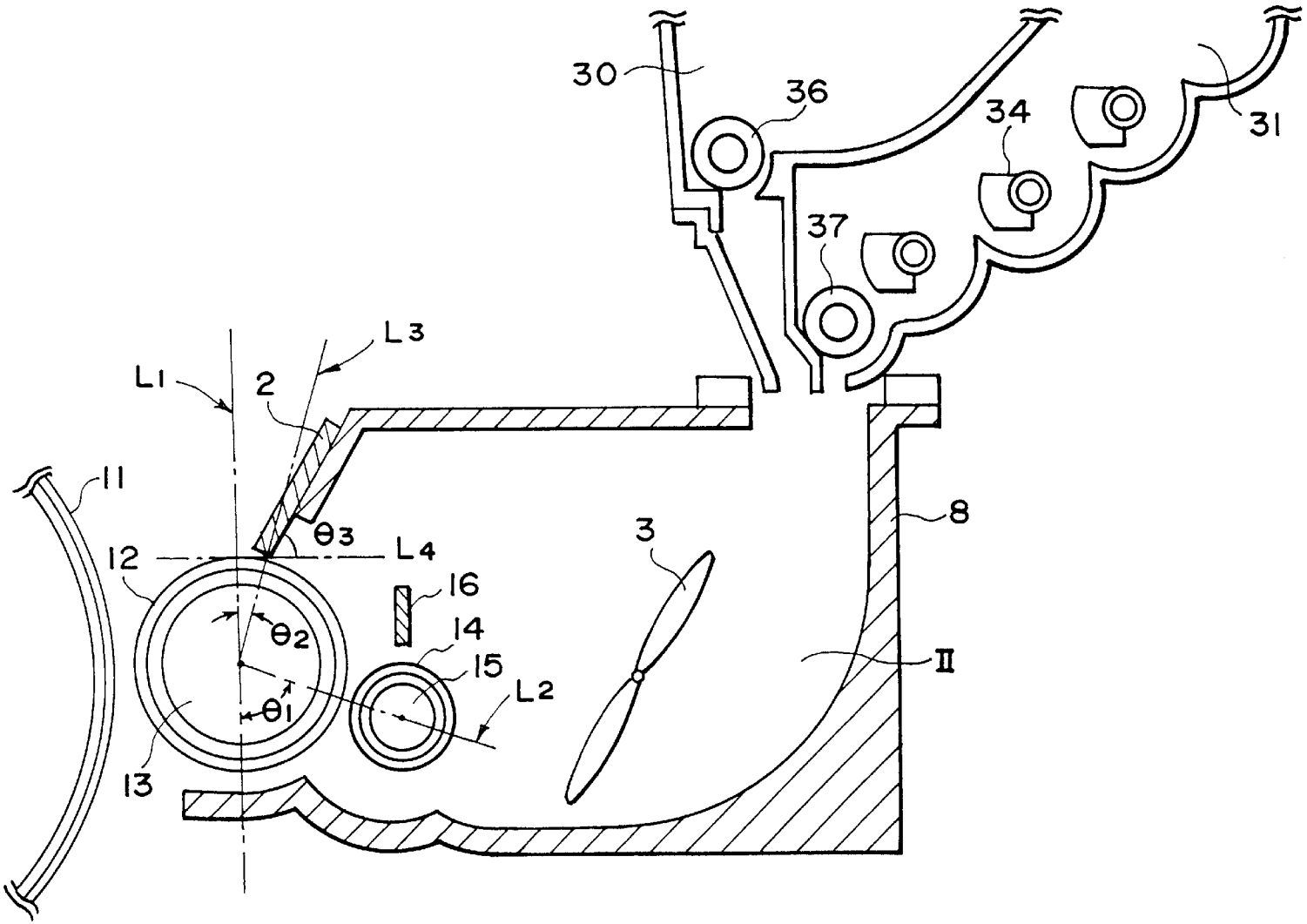
FIG. 3 is a schematic drawing of a development device for explaining angles $\theta_1$ and $\theta_2$.

Further, as shown in FIG. 3, the rotating member 14 is placed preferably so that the vertical line $L_1$ and a straight line $L_2$ connecting the center of the development sleeve 12 and the center of the rotating member 14 intersect each other at an angle $\theta_1$ larger than 0° and less than 90° (more preferably from 10° to 80° still more preferably from 15° to 75°). The second magnetic blade 2 is placed preferably so that the line $L_3$ connecting the point of the second magnetic blade 2 closest to the surface of the development sleeve 12 and the vertical line $L_1$ intersect each other at an angle $\theta_2$ larger than 0° and less than 80° (more preferably from 5° to 60°, still more preferably from 5° to 50°).

In the development device 1 satisfying the above requirements, the magnetic toner is fed smoothly from the rotating member 14 to the development sleeve 12, even at a high process speed (70 or more of A4-size paper sheets per minute, or 80 or more sheets per minute), whereby the magnetic toner is transferred from the surface of the development sleeve to the rotating member 14 after the passage through the development region, the deterioration of the magnetic toner in the development device is prevented even in long-term running (or many sheet copying) and the recovered magnetic toner can be reused without trouble.

More preferably, for retarding the deterioration of the magnetic toner by the second magnetic blade 2, the second blade 2 is placed at an angle of $\theta_3$ ranging from 40° to 85° (still more preferably from 50° to 80°) to the line $L_4$ passing through the tip of the second blade 2 perpendicularly to the vertical line $L_1$.

In FIG. 2, a magnetic pole $S_4$ of the first fixed magnet 15 opposing to the first magnetic blade 16 is magnetized preferably in the range from 750 to 1150 gausses (G) [750 to $1150\times10^{-4}$ teslas (T)]; a magnetic pole $N_4$, preferably from 600 to 1000 gausses (G) [600 to $1000\times10^{-4}$ teslas (T)]; a magnetic pole $S_5$, preferably from 300 to 700 gausses (G) [300 to $700\times10^{-4}$ teslas (T)]; and a magnetic pole $N_5$, preferably from 700 to 1100 gausses (G) [700 to $1100\times10^{-4}$ teslas (T)].

In the second fixed magnet 13, a magnetic pole $N_1$ opposing to the second magnetic blade 2 is magnetized preferably in the range from 750 to 1150 gausses (G) [750 to $1150\times10^{-4}$ teslas (T)]; a magnetic pole $S_1$, preferably from 750 to 1150 gausses (G) [750 to $1150\times10^{-4}$ teslas (T)]; a magnetic pole $N_2$, preferably from 750 to 1150 gausses (G) [750 to $1150\times10^{-4}$ teslas (T)]; a magnetic pole $S_2$, preferably from 450 to 850 gausses (G) [450 to $850\times10^{-4}$ teslas (T)]; a magnetic pole $N_3$, preferably from 300 to 700 gausses (G) [300 to 700×10–4 teslas (T)]; and a magnetic pole $S_3$, preferably from 700 to 1100 gausses (G) [700 to $1100\times10^{-4}$ teslas (T)].

Figure 4:
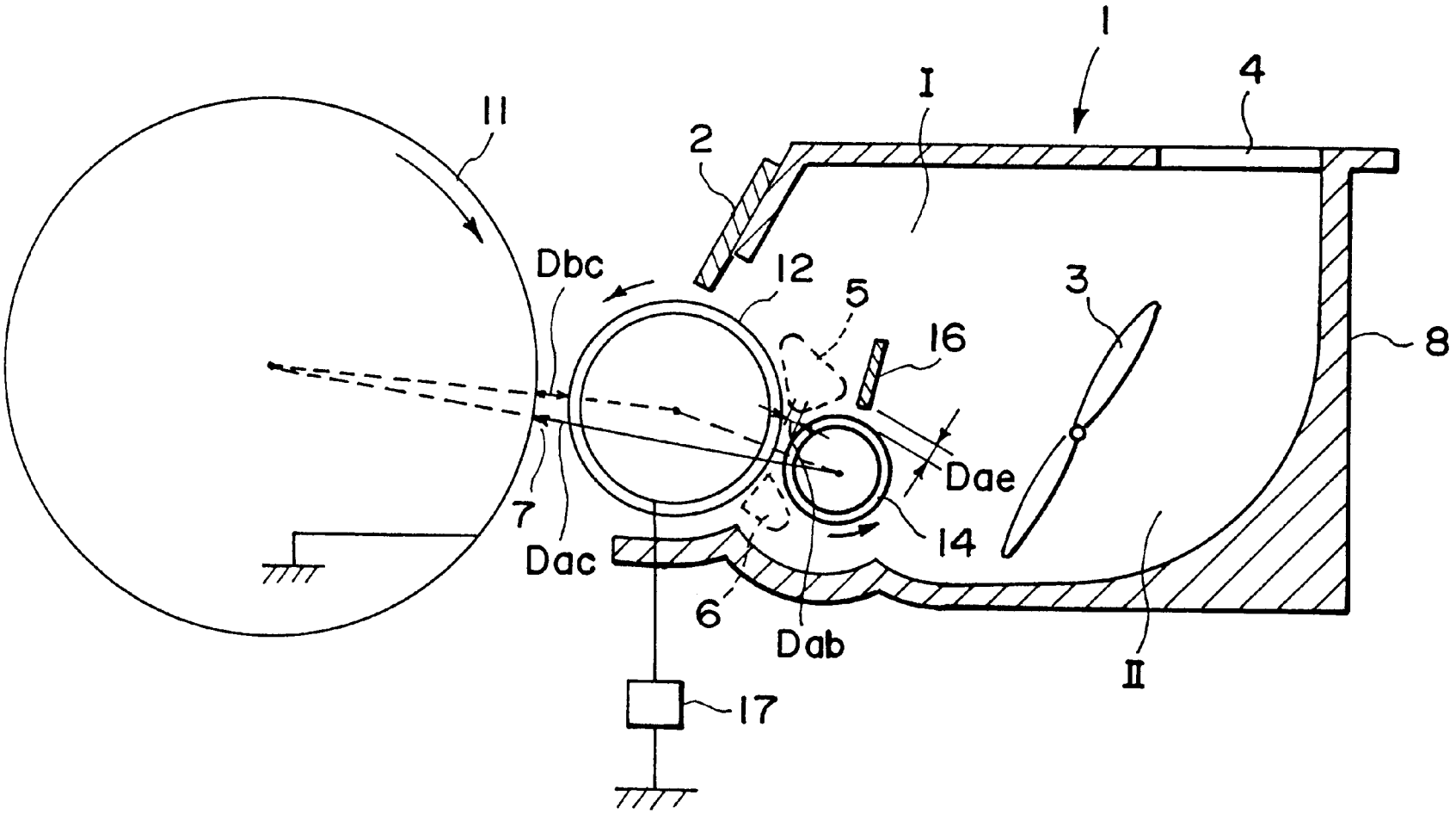
FIG. 4 is a schematic drawing for illustrating the behavior of a magnetic toner in a development device.

FIG. 4 is a sectional view of another embodiment of the development device employed in the present invention.

A development device 1 has a toner vessel 8, and therein a development room I and a toner storage room II. At the opening of the development room I facing to a photosensitive drum 11, a development sleeve 12 is placed rotatively with a prescribed gap from the photosensitive drum 11. A fixed magnet is provided in the development sleeve 12. The toner storage room II stores the magnetic toner. The development sleeve 12 is rotated at a prescribed peripheral speed in the direction reverse to the rotation of the photosensitive drum 11. On the back side of the development sleeve 12, a nonmagnetic rotating member 14 enclosing a fixed magnet 15 is placed as a toner applying means. A magnetic blade 2 is placed above the development sleeve 12. In the toner storage room II, a stirrer 3 is provided for stirring and delivering the stored magnetic toner. At the top cover plate of the toner storage room, a replenishing opening 4 is provided to connect a first-toner replenishing hopper and a second-toner replenishing hopper.

Generally, there is the distribution of the electric charge quantity of the toner particles, like the particle size distribution of the toner particles. The electric charge distribution of the magnetic toner particles depends on the dispersion state of the magnetic toner-constituting material (e.g., binder resin, magnetic material, colorant, release agent, charge-controlling agent, etc.), and the toner particle size distribution. When the magnetic toner-constituting materials are uniformly dispersed in the respective magnetic toner particles, the electric charge distribution of the magnetic toner is mainly affected by the magnetic toner particle size distribution. Generally, a smaller magnetic toner particle is charged more, whereas a larger magnetic toner particle is charged less. The magnetic toner particles charged more exhibit a broader charge distribution, whereas the magnetic toner particles charged less exhibit a narrower charge distribution.

Upon investigation based on the idea that a high image quality and a high image density can be realized by frictionally charging the magnetic toner particles sufficiently and uniformly without impairing the fluidity of the magnetic toner in the development vessel over a long period of time, the inventors of the present invention discovered the following.

As shown in FIG. 4, a rotating member 14 enclosing a fixed magnet is provided as a magnetic toner-applying member for a development sleeve 12 on the back side of the development sleeve 12. This rotating member 14 carries and delivers the magnetic toner by rotation to the development sleeve 12. Thereby, satisfactory development can be conducted in various kinds of copying, obtaining uniform copied images.

Since the magnetic toner is mixed and agitated at the gap between the rotating member enclosing the fixed magnet and the development sleeve enclosing another fixed magnet by the magnetic force generated by the magnets, the toner having a sufficient frictional electric charge can be fed with a narrow charge distribution to a development region 7 facing to a photosensitive drum 11. Thereby, a uniform toner image is obtainable with high image density without toner scattering in the processes of development, transfer, and fixing and without image defects.

The magnetic toner on the development sleeve 12 after passing through the development region 7 is scraped by the magnetic force at the gap between the rotating member 14 and the development sleeve 12 and circulated through the toner to the toner storage room II of the development vessel 8. Thereby, the same toner on the development sleeve 12 can be inhibited from being repeatedly subjected to a load, and the excessive charging or deterioration of the toner can be prevented without the formation of a sleeve ghost or without a drop of image density.

In particular, a sufficiently high image quality and image density can be provided even by using a magnetic toner having a volume-average particle diameter ($D_v$) ranging from 2.0 to 10.0 $\mu$m.

In the development device in FIG. 4, a magnet having four magnetic poles is placed non-rotatively in the cylindrical rotating member 14, and one of the magnets faces to a first magnetic blade 16. The surface of the rotating member 14 may be covered or coated with a metal or a resin, or may be treated by blasting.

A fresh toner is fed through a first toner-replenishing hopper and through an opening 4 to the toner storage room II. The replenished magnetic toner is delivered by a crank-shaped fourth stirrer 3 to the development room I. The magnetic toner is held on the surface of the rotating member 14 by the magnetic force of the fixed magnet enclosed in the rotating member 14. The magnetic toner held on the rotating member 14 is delivered by rotation of the rotating member 14 to the development sleeve 12, and is applied onto the development sleeve 12 uniformly in the lengthwise direction.

On the downstream side in the rotation direction of the development sleeve 12, a space 5 is formed where the magnetic forces from both the rotating member 14 and the development sleeve 12 act. The magnetic toner applied onto the sleeve 12 is delivered to this space 5, and is agitated and mixed well by the magnetic force from the rotating member 14 and the development sleeve 12, and is frictionally charged.

Thereafter the magnetic toner layer on the development sleeve 12 is controlled to have a prescribed layer thickness by a second magnetic blade 2. The toner layer is delivered to the development region 7 where the development sleeve 12 and the photosensitive drum 11 are opposed to each other. Then the magnetic toner is used to develop an electrostatic image on the photosensitive drum under an alternate electric field of a development bias applied by a bias-applying means 17 between the development sleeve 12 and the photosensitive member 11.

The magnetic toner not having been consumed for the development is returned with rotation of the development sleeve 12 into the development device 1. On the upstream side in the rotation direction of the development sleeve 12, a space 6 is formed where the magnetic forces from both a fixed magnet in the rotating member 14 and another magnet in the development sleeve 12 act. The magnetic toner returned to the development apparatus 1 is scraped off in this space 6 from the face of the development sleeve 12 by the magnetic forces of the magnets in the rotating member 14 and the development sleeve 12. The scraped magnetic toner is transferred to the rotating means 14, and is returned to the toner storage room II. There, it is mixed with a fresh magnetic toner replenished through the first toner-replenishing toner, and the mixed toner is used in the above development process.

The magnetic toner has preferably has a volume-average particle diameter Dv ranging from 2.0 to 10.0 $\mu$m, more preferably form 2.5 to 9.5 $\mu$m, still more preferably from 2.5 to 6.0 $\mu$m. The toner having a volume-average particle diameter of less than 2.0 $\mu$m is affected excessively by the development sleeve 12 to result in insufficient frictional charging and incomplete scraping of the magnetic toner, tending to cause problems such as toner image scattering, toner scattering, and a decrease of image density. On the other hand, the toner having the volume-average particle diameter of more than 10.0 $\mu$m is inferior in reproducibility of thin lines and dots, resulting in deterioration in the image quality.

The density Ga of the magnetic flux produced by the rotating member 14 is preferably not less than 100 gausses [$1\times10^{-2}$ teslas (T)], preferably in the range from 300 to 1500 gausses for applicability of the toner onto the development sleeve 12. With the magnetic flux density of less than 100 gausses, the magnetic toner may not be suitably applied onto the development sleeve 12, and the magnetic toner may not be uniformly agitated and mixed to cause insufficient frictional charging of the magnetic toner.

The gap Dab between the rotating member 14 and the development sleeve 12 ranges preferably from 0.3 to 5 mm, more preferably from 0.7 to 2.9 mm. With the gap Dab of less than 0.3 mm, the magnetic toner is liable to be damaged mechanically to cause deterioration in the image quality and decrease in the image density, whereas with the gap Dab of more than 5 mm, the application of the magnetic toner by the rotating member onto the development sleeve 12, and the scraping of the magnetic toner from the development sleeve after passage through the development region may not be effected satisfactorily to cause deterioration in the toner image quality and decrease in the image density.

The ratio Dab/Dac of the gap Dab between the rotating member 14 and the development sleeve to the gap Dac between the rotating member 14 and the photosensitive drum 11 ranges preferably from 0.005 to 0.8, preferably from 0.01 to 0.5. In the ratio Dab/Dac larger 0.8, the rotating member 14 may not scrape satisfactorily the toner from the development sleeve 12. In the ratio Dab/Dac of less than 0.005, the magnetic toner is liable to deteriorate.

The ratio Ra/Rb of the peripheral velocity Ra of the rotating member 14 to the peripheral velocity Rb of the development sleeve 12 ranges preferably from 0.90 to 2.00, more preferably from 1.01 to 1.50. In the ratio Ra/Rb of lower than 0.90, the rotating member 14 is not able to scrape satisfactorily the toner from the development sleeve 12. In the ratio Ra/Rb of higher than 2.00, the magnetic toner is fed excessively to the development sleeve 12, tending to retard uniform agitation and mixing of the magnetic toner and to retard electric charging by the magnetic forces of the development sleeve 12 and the rotating member 14 in the downstream space 5, while the magnetic toner is satisfactorily scraped from the development sleeve 12. The peripheral speed of the development sleeve ranges preferably from 550 to 1000 mm/sec, more preferably from 600 to 900 mm/sec.

The rotating member 14 may be rotated either in the same direction as the development sleeve 12 or in the reverse direction thereto for achieving the effect of the present invention. However, the rotating member 14 is preferably rotated in the same direction as the development sleeve 12 in order to apply and scrape the magnetic toner efficiently.

The ratio ra/rb of the outside diameter ra of the rotating member 14 to the outside diameter rb of the development sleeve 12 ranges preferably from 0.1 to 1, more preferably from 0.2 to 0.8. In the ra/rb ratio of lower than 0.1, and higher than 1, the magnetic forces of the rotating member 14 and the development sleeve 12 may not readily be well balanced, resulting in insufficient agitation and mixing of the magnetic toner by the magnetic forces, and decrease in the frictional electric charging.

In FIG. 4, the first magnetic blade 16 is placed on the upstream side in the rotation direction of the rotating member 14 relative to the closest portion between the rotating member 14 and the developing sleeve 12. Thus the first magnetic blade 16 controls the delivery of the magnetic toner held on the rotating member 14 to the development sleeve 12 to uniformalize the amount of the toner applied onto the development sleeve 12, and to increase the frictional electric charging.

The ratio Dab/Dae of the gap Dab between the rotating member 14 and the development sleeve 12 to the gap Dae between the first magnetic blade 16 and the rotating member 14 ranges preferably from 0.1 to 1.0, more preferably from 0.2 to 0.8. In the ratio Dab/Dae of lower than 0.1, the magnetic toner may be deteriorated by the action of the rotating member 14 and the development member sleeve 12. In the ratio Dab/Dae of higher than 1.0, the feed of the magnetic toner to the development sleeve 12 may be insufficient.

According to the present invention, the toner in three different states, namely the recovered magnetic toner, the magnetic toner stored in the toner storage room II, and the fresh toner replenished to the toner storage room II, are agitated and mixed well to be electrically charged sufficiently, so that high quality of images is achievable without deterioration in the image quality and decrease in the image density.

The cylindrical member as the rotating member 14 may be made of a metal or a ceramic material. Aluminum or stainless steel (SUS) is preferred in view of the ability of charging the magnetic toner. As the rotating member 14, materials worked by drawing or cutting may be used as they are, but the surface thereof may be polished, roughened in the peripheral direction or lengthwise direction, blasted, or coated. In the embodiment of the present invention, blasting is preferred. The blasting may be conducted with regular-shaped particles, irregular-shaped particles, or a mixture thereof. The surface may be subjected to double blasting. The irregular-shaped particles include abrasive grains. The regular-shaped particles include rigid spherical particles of a metal such as stainless steel, aluminum, steel, nickel, and brass; rigid spherical particles of ceramics, plastics, and glass beads. The rigid particles are in the shape of a sphere or a spheroid, having substantially a curved surface. The ratio of the major diameter to the minor diameter of the particles ranges preferably from 1 to 2, more preferably from 1 to 1.5, still more preferably from 1 to 1.2. The major diameter or the diameter of the particles ranges preferably from 20 to 250 $\mu$m.

In the case where the cylinder surface is subjected to double blasting treatment, the regular-shaped particles are preferably larger than the irregular-shaped particles by a factor of from 1 to 2, more preferably from 1 to 1.9, and at least one of processing time and the particle collision force by the regular-shaped particles is preferably less than that of the irregular-shaped particles.

The surface of the rotating member 14 is preferably coated with a resin layer containing electroconductive fine particles. The electroconductive fine particles includes carbon black, and crystalline graphite.

The crystalline graphite is classified roughly into natural graphite and artificial graphite. The artificial graphite is produced by solidifying pitch cokes with tar pitch, calcining it at a high temperature of about 1200° C., then processing it at a higher temperature of about 2300° C. in a graphitizing furnace. In the high temperature treatment, the carbon crystal grows into graphite. The natural graphite is formed from ferns of ancient times by graphitization by heat and pressure of the earth under the ground for long years, and is dug out of the earth.

The graphite is a soft lubricating crystalline mineral having gray or black gloss. The graphite has a crystalline structure of a hexagonal system or a rhombohedral system, and has a complete layer structure. The graphite has high electrocohductivity owing to free electrons between carbon-carbon bonds. Because of the various excellent properties, the graphite is used not only for pencils but also for various industrial uses, such as lubricating agents, fire-resistant materials, and electric materials in a state of powder, solid, or paint owing to its heat resistance and chemical stability.

The graphite for use in the present invention may be either a natural product or an artificial product, and having an average particle diameter ranging preferably from 0.5 to 20 $\mu$m.

The resin for the coating layer of the rotating member 14 includes thermoplastic resins such as styrenic resins, vinyl resins, polyether sulfone resins, polycarbonate resins, polyphenylene oxide resins, polyamide resins, fluororesins, cellulose resins, and acrylic resins; thermosetting resins such as epoxy resins, polyester resins, alkyd resins, phenol resins, melamine resins, polyurethane resins, urea resins, silicone resins, and polyimide resins; and photosetting resins. Of these resins, preferred are silicone resins and fluororesins owing to their excellent releasability; polyether sulfone resins, polycarbonate resins, polyphenylene oxide resins, polyamide resins, phenol resins, polyester resins, polyurethane resins, and styrenic resins owing to their excellent mechanical properties.

The electroconductive amorphous carbon is generally defined as an aggregate of crystals formed by burning or thermally decomposing a hydrocarbon or a carbon-containing compound under insufficient oxygen supply. The electroconductive amorphous carbon is widely used because of its high electroconductivity as a filler of polymer materials for imparting electroconductivity thereto, or as an additive for controlling electroconductivity of materials. The electroconductive amorphous carbon used in the present invention has preferably an average particle diameter ranging from 10 to 80 $\mu$m, more preferably from 15 to 40 $\mu$m.

The magnetic toner particles preferably contain fine powdery silica added externally and mixed thereto. The externally added fine powdery silica prevents or decrease abrasion of the surface of the magnetic toner particles by friction with the development sleeve 12, and reduces the drop of fluidity of the magnetic toner. The amount of the fine powdery silica to be added ranges preferably from 0.01 to 8 parts by weight, more preferably from 0.1 to 5 parts by weight per 100 parts by weight of the magnetic toner particles. The fine powdery silica preferably has a length-average particle diameter ranging from 5 to 200 nm, or a BET specific surface area ranging from 100 to 400 $m^2/g$.

The magnetic toner particles may additionally contain fine powdery metal oxide added externally or mixed thereto, such as strontium titanate, calcium titanate, and cerium oxide. The fine powdery metal oxide serves to impart frictional electric charge to the magnetic toner particles by friction with the toner particles. The fine powdery metal oxide is added in an amount ranging preferably from 0.01 to 10 parts by weight, more preferably from 0.03 to 5 parts by weight, based on 100 parts by weight of the magnetic toner particles. The fine powdery metal oxide other than the fine powdery silica has a length-average diameter ranging from 0.3 to 3 $\mu$m, more preferably from 0.3 to 2.5 $\mu$m, or a BET surface area ranging preferably from 0.5 to 15 $m^2/g$.

In the production of the magnetic toner, a binder resin such as a thermoplastic resin, a magnetic material, a charge-controlling agent, a releasing agent, and other additives are sufficiently mixed by means of a mixer like a ball mill, and the mixture is melt-blended by a heat-blending machine such as a hot roll, a kneader, and an extruder to disperse the magnetic material in the binder resin. After cooling and solidification, the melt-blended mixture is pulverized, and classified to produce magnetic toner particles of a desired particle size. A fluidizing agent such as fine powdery silica, or an electric charging agent such as a metal oxide is added thereto, if necessary, by means of a dry mixing machine such as a Henschel mixer and a PapenMayer mixer.

The following examples are provided to illustrate the present invention but do not imply any limitation of the scope of the invention.

In the following examples, reference to the unit "parts" is by weight unless otherwise specified.

Production Example

Binder resin [styrene/butyl acrylate/butyl maleate/divinylbenzene copolymer (weight ratio 73.5/19/7/0.5)] 100 parts Magnetic material [magnetic iron oxide (average particle diameter: 0.2 μm)] 85 parts Charge-controlling agent [chromium complex of 3,5-di-t-butylsalicylic acid (number-average particle diameter: 2.8 μm)] 2 parts Release agent [low molecular weight polypropylene] 3 parts The above materials were premixed well by a blender-mixer. The mixture is blended by a twin-screw extruder set at 150° C. The melt-blended matter was cooled, crushed by a cutter mill, finely pulverized by a pulverizer employing a jet air stream, and classified by a fixed wall type pneumatic classifier. The classified powdery material is further strictly classified to eliminate simultaneously an ultra-fine powdery fraction and a coarse powdery fraction by a multi-division classifier utilizing the Coanda effect (Elbow Jet Classifier, manufactured by Nittetsu Kogyo K.K.), obtaining black magnetic toner particles having a volume-average particle diameter (D4) of 5.7 μm.

To 100 parts of this magnetic toner particles, were added 1.0 part of fine powder of negatively chargeable hydrophobic dry silica having a length-average diameter of 20 nm and a BET specific surface area of 240 $m^2/g$, and 0.5 part of strontium titanate having a length-average diameter of 0.8 μm and a BET specific surface area of 1 $m_2/g$. The mixture was blended by a Henschel mixer to produce negatively chargeable Magnetic Toner No. 1 having a volume-average particle diameter of 5.7 μm.

EXAMPLE 1

A development device as shown FIGS. 1, 2, and 3 was used. The rotating member 14 was a stainless steel cylinder of 20 mm diameter which was blasted on its surface with #300 glass beads, and enclosed a four-polar fixed magnet roller 15. The base member of the development sleeve 12 was composed of an aluminum cylinder whose surface had been processed by blasting with #300 glass beads. The cylinder had a diameter of 32 mm. The surface of the base member of the development sleeve 12 was coated with a phenol resin containing carbon and graphite dispersed therein in a layer thickness of 20 μm. In the development sleeve 12, a six-pole fixed magnet roller was placed. The magnetic pole $N_1$ of the second fixed magnet 13 produced magnetic flux at a density of 1050 gausses; $N_2$, 1040 gausses; $N_3$, 610 gausses; $S_1$, 1020, gausses; $S_2$, 670 gausses; and $S_3$, 980 gausses. The magnetic pole $S_4$ of the first fixed magnet gave a magnetic flux density of 1000 gausses; $S_5$, 550 gausses; $N_4$, 800 gausses; and $N_5$ 750 gausses.

The gap $D_2$ between the development sleeve 12 and the second magnetic blade 2 was adjusted to 230 μm. The gap between the development sleeve 12 and the photosensitive drum 11 was adjusted to 230 μm. The gap $D_3$ (or Dab) between the rotating member 14 and the development sleeve 12 was adjusted to 1 mm. The ratio Dbc/Dac was 0.00736. The ratio RA/RB of the rotation number (RA) of the rotating member to the rotation number (RB) of the development sleeve 12 was adjusted to 1.5. The gap $D_1$ between the rotating member 14 and the first magnetic blade 16 was adjusted to 1.5 mm.

The first magnetic blade 16, and the second magnetic blade 2 were each a nickel-plated iron plate.

A high-speed copying machine (trade name NP6085, manufactured by Canon K.K.) was modified by incorporating a reuse system for a recovered magnetic toner as shown in FIG. 1, and the development device 1 was set therein.

With this copying machine, 500,000-sheet continuous copying tests were conducted at the peripheral speed of the amorphous silicon drum of 550 mm/sec (corresponding to a copying speed of 90 A4-copying paper sheets per minute), the peripheral speed of the development sleeve of 800 mm/sec, the peripheral speed of the rotating member of 900 mm/sec, with introduction of Magnetic Toner No.1 to the first toner-replenishing hopper 30 and with running of the recovered toner reuse system.

When 30,000 sheets of copying was conducted, the recovered toner delivered from the cleaning means 22 through the delivery pipe 29 began to accumulate in the second toner-replenishing hopper 31. Then, the rotation rates of the first magnet roller 36 and the second magnet roller 37 were adjusted so that the fresh magnetic toner stored in the first toner-replenishing hopper and the recovered magnetic toner were introduced in a ratio of 90 parts (fresh toner) to 10 parts (recovered toner) by weight to the toner storage room II. The running tests were conducted under the conditions of an ordinary temperature and an ordinary humidity (23.5° C., 60% RH), an ordinary temperature and a low humidity (23.5° C., 5% RH), and a high temperature and a high humidity (32.5° C., 85% RH). In any of the running tests, satisfactory image quality was maintained during the test without the adverse effect of the reuse of the recovered magnetic toner. Tables 1 to 3 shows the test results.

Evaluation methods are described below. Measurement of Volume-Average Particle Diameter of Magnetic Toner The volume-average particle diameter $D_v$ of the magnetic toner is measured by means of Coulter Multisizer (manufactured by Coulter Co.) with ISTRON R-II as the electrolyte solution (aqueous 1% NaCl solution, produced by Coulter Scientific Japan K.K.). Into 100 to 150 mL of the electrolyte solution, is added 0.1 to 5 mL of a surfactant solution, and thereto 2 to 30 mg of a sample magnetic toner is added. The sample suspended in the electrolyte solution is dispersed by a supersonic dispersing machine for about 1 to 3 minutes. The dispersed sample is subjected to measurement of the volume and the particle number of the magnetic toner by the use of the aforementioned measurement apparatus. From the results obtained, the volume-average particle diameter is calculated.

In the above measurement, a magnetic toner having a volume-average particle diameter of not less than 6 μm is measured for particles of 2 to 60 μm with a 100-μm aperture;

the one having a volume-average particle diameter in the range from 2.5 to 6 μm is measured for particles of 1 to 30 μm with a 50-μm aperture; and the one having a volume-average particle diameter of not more than 2.5 μm is measured for particles of 0.6 to 18 μm with a 30-μm aperture. Image Density The image density is determined by measuring the reflective density for circular areas of 5 mm diameter with a MacBeth Densitometer (Model RD918, manufactured by MacBeth Co.).

Fogging

The fogging of the image is measured by using a reflectodensitometer (Reflectometer TC-6DS, manufactured by Tokyo Denshoku K.K.). The fogging degree (%) is evaluated by Ds-Dr: the difference between the reflection density Dr (%) of the recording medium before image formation and the maximum reflection density Ds (%) of a white blank area of the recording medium after the image formation.

Sleeve Ghost

After forming the images of image ratios 6% and 15% as mentioned above, an A3-sized test pattern sheet having a lattice pattern on a solid white background at its front end portion and a halftone area at its rear end portion is copied. The sleeve ghost level is evaluated on the following six grades according to the shadow of the lattice appearing on the halftone area.

A: No lattice ghost observed,

B: Slight lattice ghost observed, but disappearing after one or two sheets of copying, C: Slight lattice ghost observed, but disappearing after several sheets of copying, D: Slight lattice ghost observed, and remaining after repeated copying, E: Lattice ghost remarkable, F: Lattice ghost serious Image Quality Image quality is evaluated on the following four grades according to the synthetic visual observation of the uniformity of a solid black image, gradation, fine line reproducibility, and fogging.

A: Excellent, B: Good, C: Fair, D: Poor

Comparative Example 1

Figure 5:
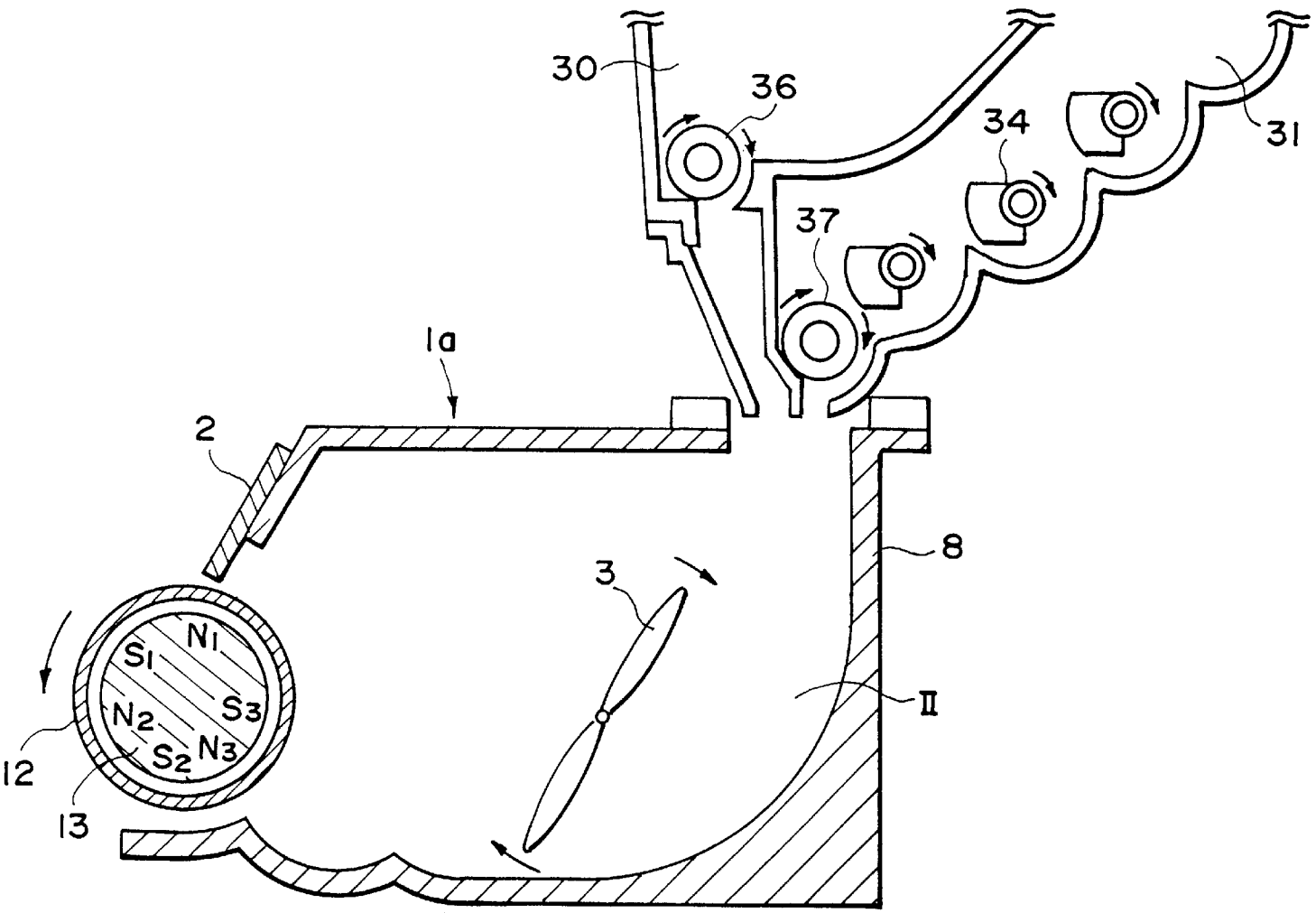
FIG. 5 is a schematic drawing of Comparative Development Device No. 1 (1*a*).

The copying test was conducted in the same manner as in Example 1 except that the development device was modified by removing the rotating member 14, the first fixed magnet 15, and the first magnetic blade 16 as shown by the comparative development device 1*a* in FIG. 5. The fixed images after copying 500,000 sheets were inferior to that of Example 1 in image density, fogging, and image quality. When starting to feed the recovered magnetic toner to the toner-replenishing hopper, the sleeve ghost began to appear on the copied image. The results are shown in Tables 1 to 3.

Comparative Example 2

Figure 6:
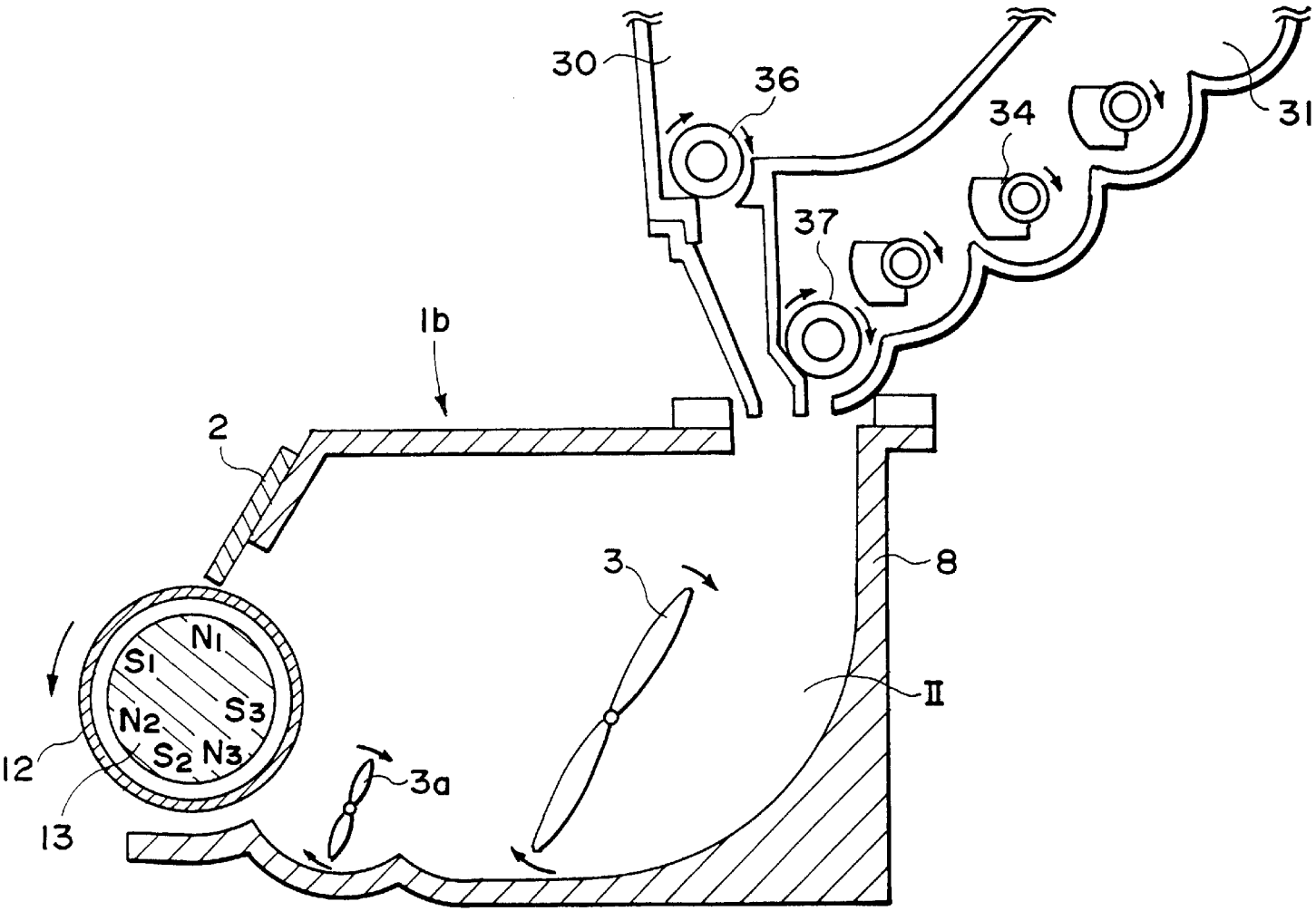
FIG. 6 is a schematic drawing of Comparative Development Device No. 2 (1*b*).

The copying test was conducted in the same manner as in Example 1 except that the development device was modified by replacing the rotating member with a stirrer 3*a* as shown by the comparative development device 1*b* in FIG. 6. The fixed image after copying 500,000 sheets were inferior to that of Example 1 in image density, fogging, and image quality. When starting to feed the recovered magnetic toner to the toner-replenishing hopper, the sleeve ghost came to emerge on the copied image. The results are shown in Tables 1 to 3.

Comparative Example 3

Figure 7:
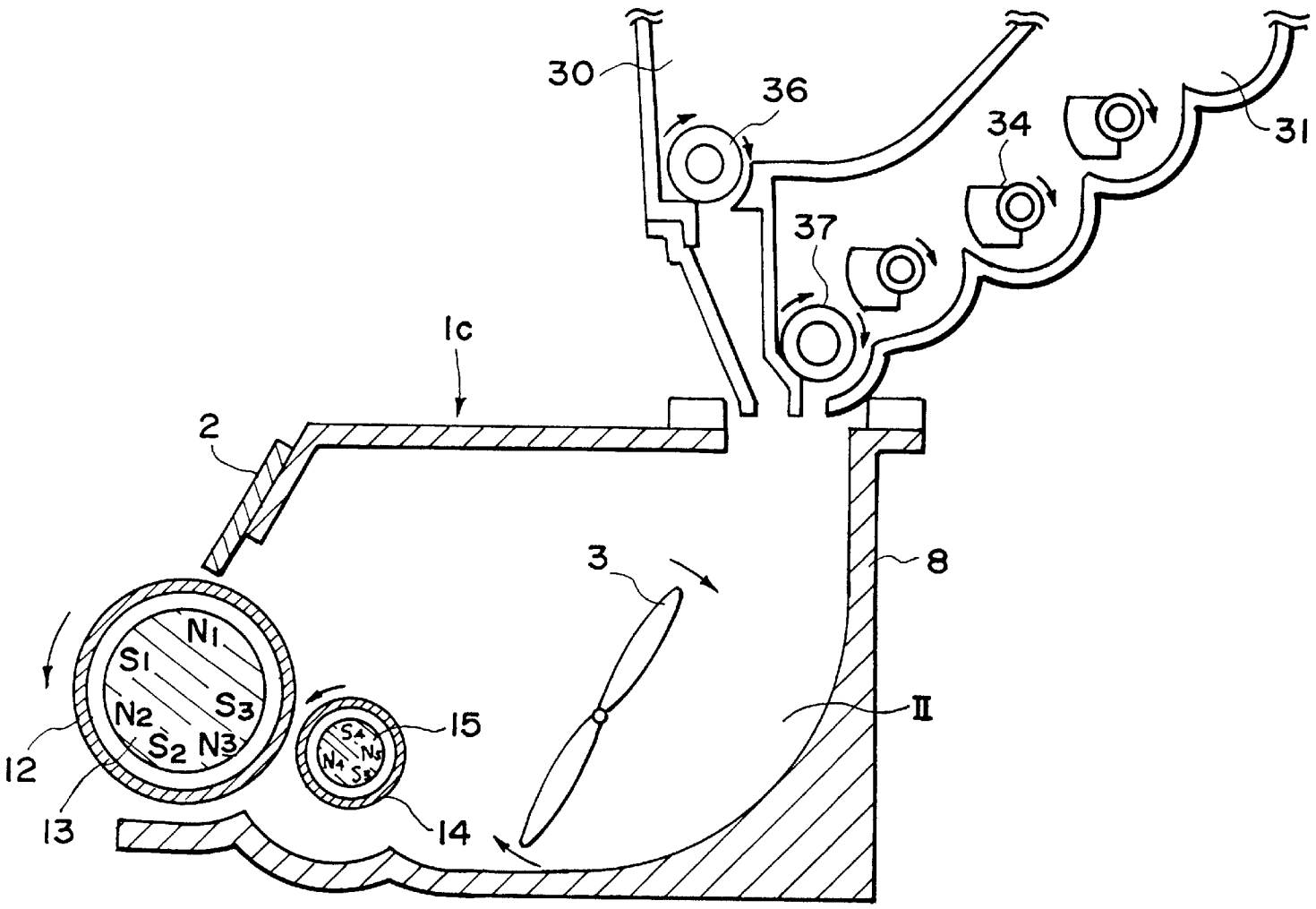
FIG. 7 is a schematic drawing of Comparative Development Device No. 3 (1*c*).

The copying test was conducted in the same manner as in Example 1 except that the first magnetic blade was removed from the comparative development device as shown by the development device 1*c* in FIG. 7. Fogging was liable to be caused. After copying 500,000 sheets toner image, streak-like fogging was observed. The results are shown in Tables 1 to 3.

Comparative Example 4

Figure 8:
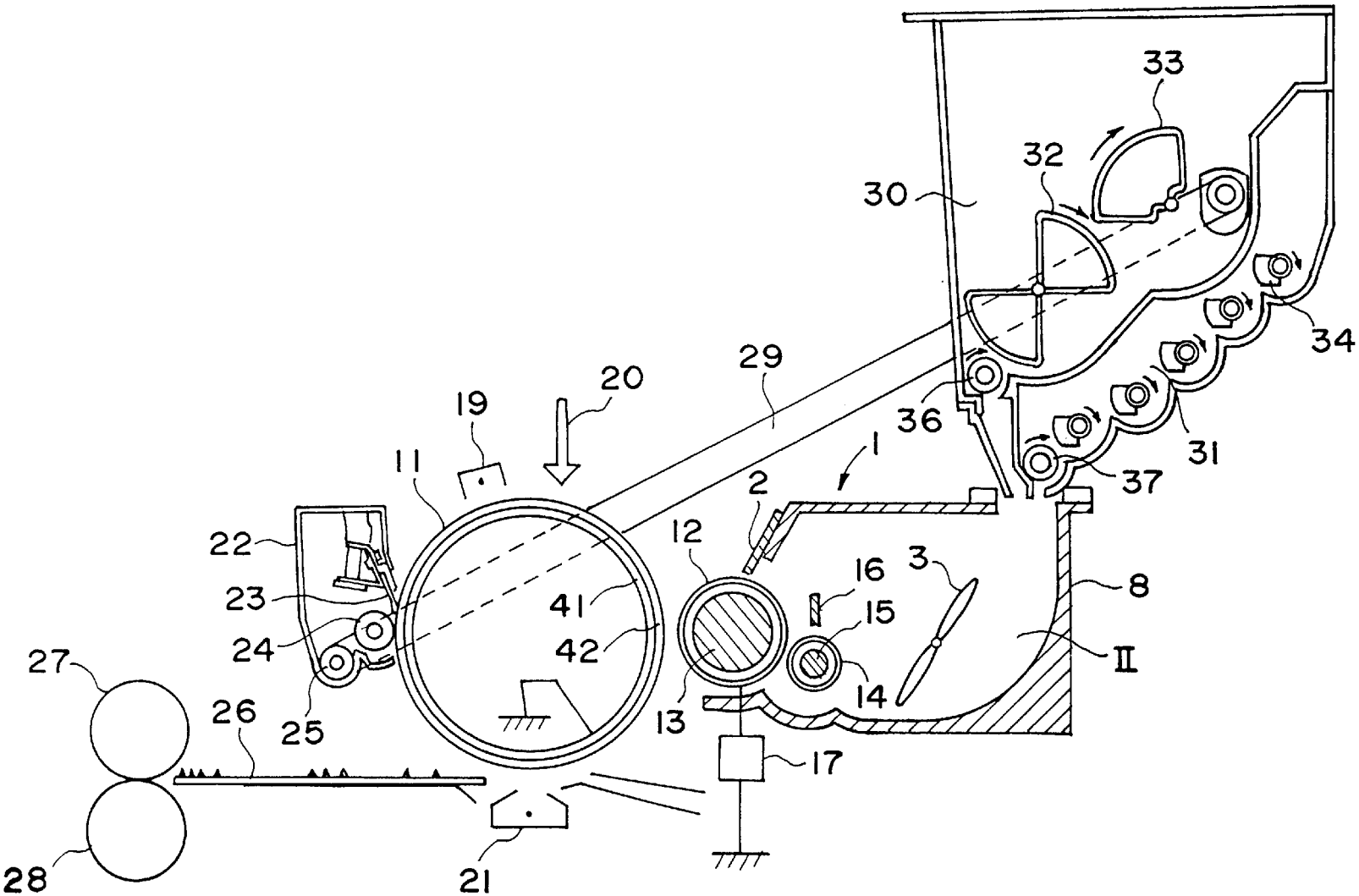
FIG. 8 is a schematic drawing of a comparative image-forming apparatus.

The copying test was conducted in the same manner as in Example 1 except that the delivery pipe for delivering the recovered magnetic toner was connected to the first toner-replenishing hopper 30 as shown in FIG. 8. The mixing ratio of the recovered magnetic toner and the fresh toner tended to vary during the running test more than Example 1, and the recovered magnetic toner and the fresh toner were difficult to uniformly mix. Tables 1 to 3 show the results.

Comparative Example 5

Figure 9:
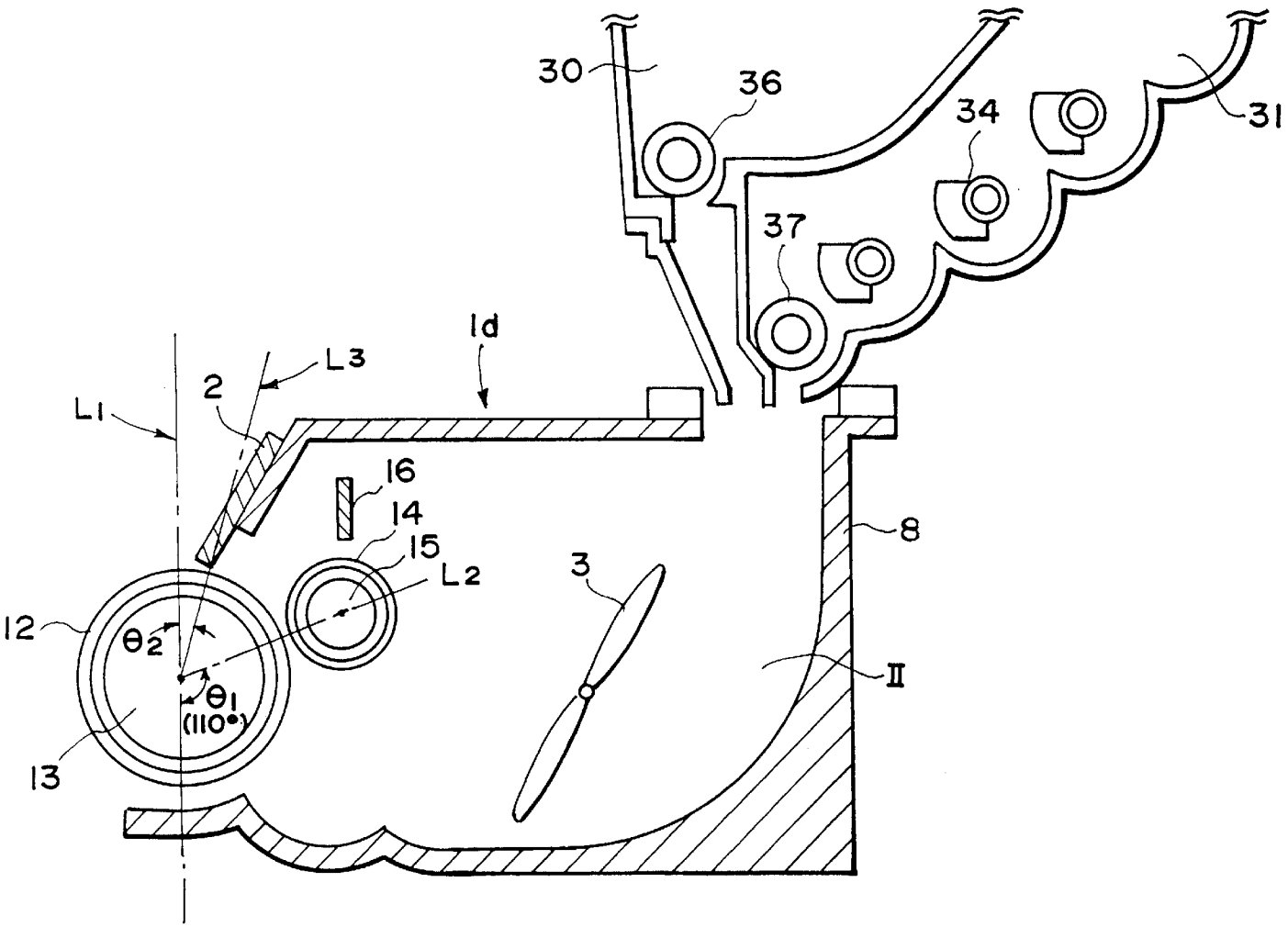
FIG. 9 is a schematic drawing of Comparative Development Device No. 4 (1*d*).

The copying test was conducted in the same manner as in Example 1 except that the rotating member 14 was reoriented to change the angle $\theta_1$ to 110° as shown by the comparative development device 1*d* in FIG. 9. In comparison with Example 1, the magnetic toner was not scraped satisfactorily by the rotating member 14 from the development sleeve 12 during the running test, and the magnetic toner was not smoothly fed by the rotating member 14 to the development sleeve 12 to cause sleeve ghost to appear and to decrease image density during the running test. Tables 1 to 3 show the results. Comparative Example 6

Figure 10:
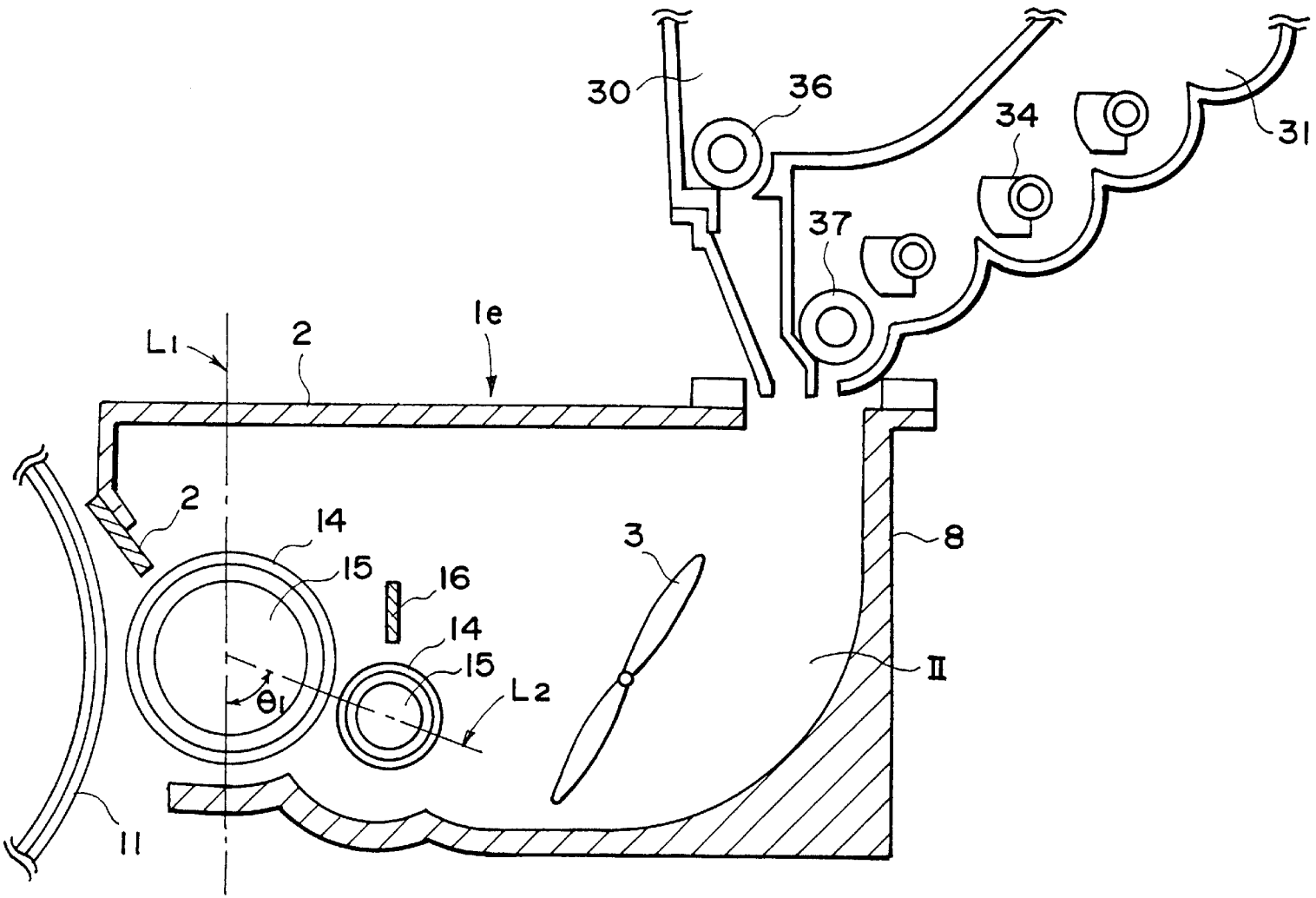
FIG. 10 is a schematic drawing of Comparative Development Device No. 5 (1*e*).

The copying test was conducted in the same manner as in Example 1 except that the second magnetic blade 2 was placed on the same side as the photosensitive drum 11 relative to the vertical line $L_1$ as shown by the comparative development device 1*e* in FIG. 10. In comparison with Example 1, during the running test, the magnetic toner accumulated excessively on the right side of the second magnetic blade, decreasing the image density and increasing the fogging. Tables 1 to 3 show the results.

Comparative Example 7

Figure 11:
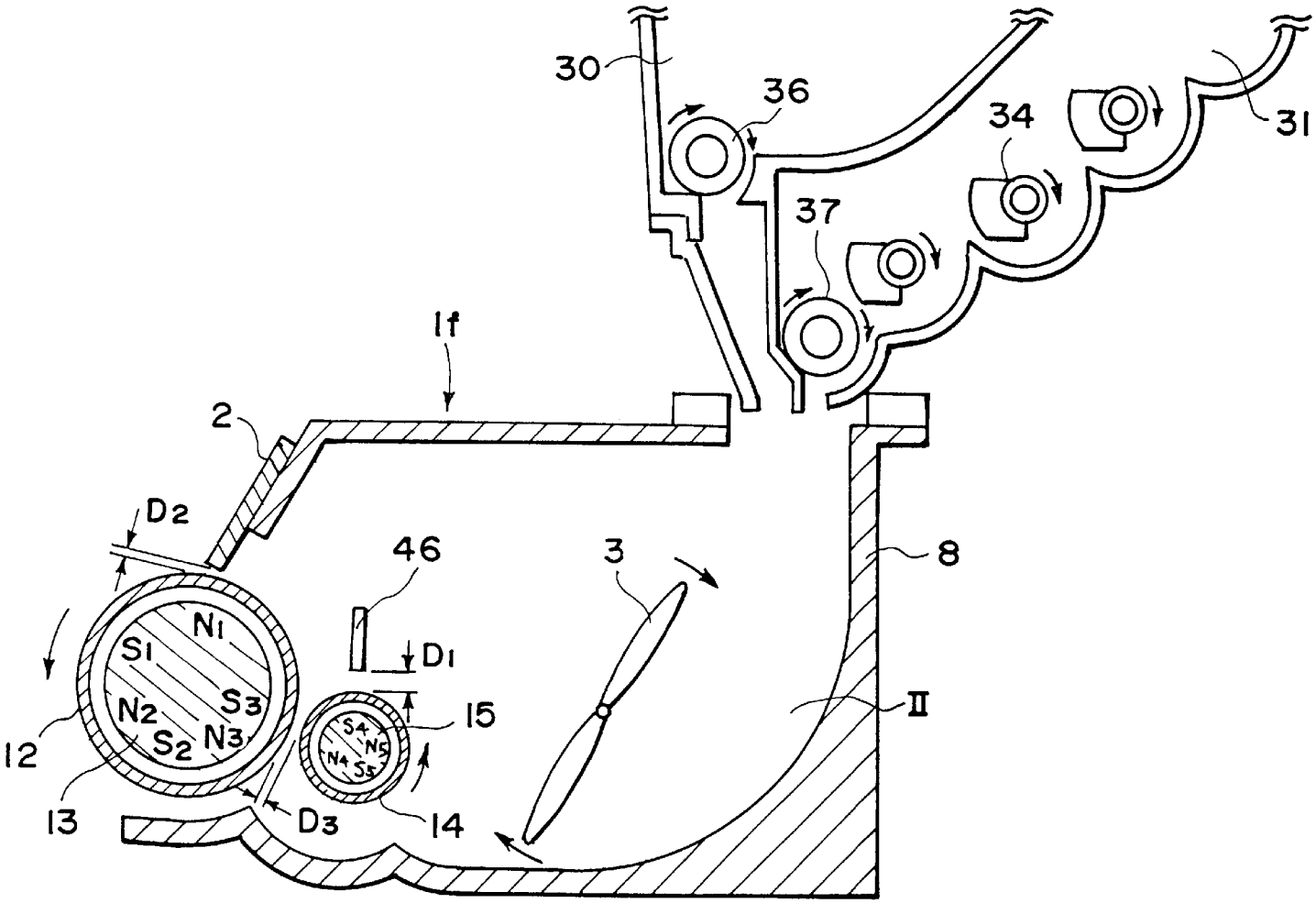
FIG. 11 is a schematic drawing of Comparative Development Device No. 6 (1*f*).

The copying test was conducted in the same manner as in Example 1 except that a nonmagnetic aluminum blade 46 was used in place of the first magnetic blade 16 as shown by the comparative development device 1*f* in FIG. 11. In comparison with Example 1, during the running test, when the feed of the recovered magnetic toner to the toner replenishing hopper was started, the aggregate of the recovered magnetic toner came not to be finely pulverized, causing streak-like fogging. Tables 1 to 3 show the results.

Comparative Example 8

The copying test was conducted in the same manner as in Example 1 except that the comparative development device 1*g* was used in which the gap $D_1$ was adjusted to 1.0 mm, the gap $D_2$ to 0.23 mm, and the gap $D_3$ to 2.0 mm ($D_3>D_1>D_2$). The fixed images after copying 500,000 sheets were inferior to that of Example 1 in image density, fogging, and image quality. When starting to feed the recovered magnetic toner to the toner-replenishing hopper, the sleeve ghost came to emerge on the copied image. The results are shown in Tables 1 to 3.

EXAMPLE 2

The copying test was conducted in the same manner as in Example 1 except that the magnetic toner was changed to Magnetic Toner No. 2 which had been prepared in the same manner as Production Example mentioned above and had a volume-average particle diameter of 8.5 $\mu$m. The results are shown in Tables 1 to 3.

EXAMPLE 3

The copying test was conducted in the same manner as in Example 1 except that the magnetic toner was changed to Magnetic Toner No. 3 which had been prepared in the same manner as Production Example mentioned above and had a volume-average particle diameter of 11.0 $\mu$m. The results are shown in Tables 1 to 3.

EXAMPLE 4

The copying test was conducted in the same manner as in Example 1 except that the magnetic toner was changed to Magnetic Toner No. 4 which had been prepared in the same manner as Production Example mentioned above and had a volume-average particle diameter of 2.0 $\mu$m. The results are shown in Tables 1 to 3.

EXAMPLE 5

The copying test was conducted in the same manner as in Example 1 except that the magnetic toner was changed to Magnetic Toner No. 5 which contained, as the external additive, only hydrophobic fine powdery silica. The results are shown in Tables 1 to 3.

TABLE 1

| | Ordinary-Temperature Ordinary-Humidity Conditions | | | | | | | |
|---|---|---|---|---|---|---|---|---|
| | Image density | | Fogging (%) | | Sleeve ghost | | Image quality | |
| | Start | 500,000th copy | Start | 500,000th copy | Start | 500,000th copy | Start | 500,000th copy |
| Example | | | | | | | | |
| 1 | 1.48 | 1.49 | 1.1 | 1.4 | A | A | A | A |
| Comparative Example | | | | | | | | |
| 1 | 1.35 | 1.17 | 1.9 | 4.6 | C | D | B | C |
| 2 | 1.47 | 1.09 | 1.6 | 3.9 | C | D | B | C |
| 3 | 1.49 | 1.42 | 0.8 | 3.5 | A | B | A | B |
| 4 | 1.48 | 1.47 | 0.9 | 3.9 | A | C | A | C |
| 5 | 1.43 | 1.27 | 1.4 | 3.4 | A | B | B | C |
| 6 | 1.49 | 1.28 | 1.4 | 3.5 | A | B | A | B |
| 7 | 1.48 | 1.45 | 1.8 | 3.9 | A | C | B | C |
| 8 | 1.42 | 1.21 | 1.8 | 3.8 | C | C | A | C |
| Example | | | | | | | | |
| 2 | 1.47 | 1.47 | 0.6 | 0.8 | A | A | B | B |
| 3 | 1.46 | 1.45 | 0.6 | 0.6 | A | A | B | B |
| 4 | 1.47 | 1.48 | 1.7 | 1.9 | A | B | A | A |
| 5 | 1.45 | 1.42 | 1.4 | 1.5 | A | A | B | B |

TABLE 2

| | Ordinary-Temperature Low-Humidity Conditions | | | | | | | |
|---|---|---|---|---|---|---|---|---|
| | Image density | | Fogging (%) | | Sleeve ghost | | Image quality | |
| | Start | 500,000th copy | Start | 500,000th copy | Start | 500,000th copy | Start | 500,000th copy |
| Example | | | | | | | | |
| 1 | 1.48 | 1.49 | 1.6 | 1.9 | A | A | A | A |
| Comparative Example | | | | | | | | |
| 1 | 1.35 | 1.17 | 2.3 | 6.2 | D | D | B | C |
| 2 | 1.47 | 1.09 | 1.9 | 4.6 | D | D | B | C |

TABLE 2-continued

| | Ordinary-Temperature Low-Humidity Conditions | | | | | | | |
|---|---|---|---|---|---|---|---|---|
| | Image density | | Fogging (%) | | Sleeve ghost | | Image quality | |
| | Start | 500,000th copy | Start | 500,000th copy | Start | 500,000th copy | Start | 500,000th copy |
| 3 | 1.49 | 1.42 | 1.4 | 4.2 | B | C | A | B |
| 4 | 1.48 | 1.47 | 1.3 | 4.3 | B | C | A | C |
| 5 | 1.43 | 1.27 | 1.7 | 3.9 | B | C | B | C |
| 6 | 1.49 | 1.28 | 1.9 | 4.1 | B | C | A | B |
| 7 | 1.48 | 1.45 | 2.4 | 4.1 | B | C | B | C |
| 8 | 1.42 | 1.21 | 2.5 | 5.2 | C | C | A | C |
| Example | | | | | | | | |
| 2 | 1.47 | 1.47 | 1.1 | 1.4 | A | A | B | B |
| 3 | 1.46 | 1.45 | 0.8 | 1.2 | A | A | B | B |
| 4 | 1.47 | 1.48 | 2.1 | 2.4 | B | B | A | A |
| 5 | 1.45 | 1.42 | 1.7 | 1.8 | A | A | B | B |

TABLE 3

| | High-Temperature High-Humidity Conditions | | | | | | | |
|---|---|---|---|---|---|---|---|---|
| | Image density | | Fogging (%) | | Sleeve ghost | | Image quality | |
| | Start | 500,000th copy | Start | 500,000th copy | Start | 500,000th copy | Start | 500,000th copy |
| Example | | | | | | | | |
| 1 | 1.47 | 1.47 | 0.9 | 1.2 | A | A | A | A |
| Comparative Example | | | | | | | | |
| 1 | 1.33 | 1.07 | 1.7 | 4.1 | C | C | C | C |
| 2 | 1.45 | 1.07 | 1.4 | 3.7 | C | C | C | C |
| 3 | 1.46 | 1.37 | 0.7 | 3.1 | A | B | B | C |
| 4 | 1.46 | 1.46 | 0.7 | 3.7 | A | B | C | D |
| 5 | 1.43 | 1.09 | 1.4 | 3.8 | A | B | C | D |
| 6 | 1.49 | 1.14 | 1.3 | 3.7 | A | B | B | C |
| 7 | 1.48 | 1.45 | 1.9 | 4.7 | A | C | C | C |
| 8 | 1.42 | 1.14 | 1.9 | 3.7 | B | B | B | D |
| Example | | | | | | | | |
| 2 | 1.46 | 1.48 | 0.4 | 0.7 | A | A | B | B |
| 3 | 1.47 | 1.45 | 0.5 | 0.9 | A | A | B | B |
| 4 | 1.46 | 1.47 | 1.8 | 1.9 | A | B | A | A |
| 5 | 1.45 | 1.43 | 1.3 | 1.7 | A | A | B | B |

What is claimed is:

1. An image-forming method comprising:

replenishing a magnetic toner through a first toner-replenishing hopper to a toner storage room, introducing the replenished magnetic toner from the toner storage room onto a nonmagnetic cylindrical rotating member having a first fixed magnetic field-generating means enclosed therein, delivering the magnetic toner by rotation of the rotating member, through a gap $D_1$ between a first magnetic blade and the rotating member, to a nonmagnetic cylindrical development sleeve having a second fixed magnetic field-generating means enclosed therein, delivering the magnetic toner by rotation of the development sleeve through a gap $D_2$ between a second magnetic blade and the development sleeve to form a magnetic toner layer on the development sleeve, transferring the magnetic toner from the development sleeve onto an electrostatic image holding member to develop an electrostatic image on the electrostatic image holding member and to form a magnetic toner image thereon, transferring the formed magnetic toner image onto a recording medium, recovering the magnetic toner remaining on the electrostatic image holding member after the transfer of the magnetic toner image by a cleaning means to obtain a recovered magnetic toner, and delivering the recovered magnetic toner to a second toner-replenishing hopper to feed the recovered magnetic toner to the toner storage room, wherein the first magnetic blade and the second magnetic blade are placed on the side opposite to the electrostatic image holding member relative to a vertical line $L_1$ passing through the center of the development sleeve, the center of the rotating member is placed on the vertical line $L_1$ or on the side opposite to the electrostatic image holding member relative to the vertical line $L_1$, an angle $\theta_1$ between the vertical line $L_1$ and a straight line $L_2$ connecting the center of the development sleeve and the center of the rotating member is more than 0° but less than 90°, an angle $\theta_2$ between the vertical line $L_1$ and a straight line $L_3$ connecting a point on the magnetic blade closest to the development sleeve and the center of the development sleeve and is more than 0° and less than 80°, a gap $D_3$ between the surface of the rotating means and the development sleeve satisfies the following conditions:

$$D_1 \geqq D_3 > D_2$$

and the recovered toner is fed through the gap $D_1$ to the development sleeve and used to develop an electrostatic image.

2. The image-forming method according to claim 1, wherein a ratio ($w_1/w_2$) of the weight $w_1$ of the feed of the magnetic toner from the first toner-replenishing hopper to the weight $w_2$ of the feed of the recovered toner from the second toner-replenishing hopper ranges from 5 to 20.

3. The image-forming method according to claim 1, wherein the ratio ($w_1/w_2$) of the weight $w_1$ of the feed of the magnetic toner from the first toner-replenishing hopper to the weight $w_2$ of the feed of the recovered toner from the second toner-replenishing hopper ranges from 5 to 15.

4. The image-forming method according to claim 1, wherein the development sleeve is rotated at a peripheral speed of not less than 550 mm/sec.

5. The image-forming method according to claim 1, wherein the development sleeve, the rotating member, and the first magnetic blade are placed to satisfy the following conditions:

$$D_1 > D_2 > D_3.$$

6. The image-forming method according to claim 1, wherein the magnetic toner has a volume-average particle diameter ranging from 2.0 to 10.0 $\mu$m, the gap $D_1$ ranging from 1 to 6 mm, the gap $D_2$ ranges from 0.10 to 0.50 mm, and the gap $D_3$ ranges from 0.3 to 5 mm.

7. The image-forming method according to claim 6, wherein the magnetic toner has a volume-average particle diameter ranging from 2.5 to 9.5 $\mu$m.

8. The image-forming method according to claim 6, wherein the magnetic toner has a volume-average particle diameter ranging from 2.5 to 6.0 $\mu$m.

9. The image-forming method according to claim 1, wherein the magnetic toner has a volume-average particle diameter ranging from 2.0 to 10.0 $\mu$m, the gap $D_1$ ranging from 3 to 5 mm, the gap $D_2$ ranges from 0.15 to 0.40 mm, and the gap $D_3$ ranges from 0.7 to 2.9 mm.

10. The image-forming method according to claim 1, wherein the angle $\theta_1$ ranges from 10 to 80 degrees.

11. The image-forming method according to claim 1, wherein the angle $\theta_1$ ranges from 15 to 75 degrees.

12. The image-forming method according to claim 1, wherein the angle $\theta_2$ ranges from 5 to 60 degrees.

13. The image-forming method according to claim 1, wherein the angle $\theta_2$ ranges from 5 to 50 degrees.

14. The image-forming method according to claim 1, wherein the angle $\theta_1$ ranges from 10 to 80 degrees, and the angle $\theta_2$ ranges from 5 to 60 degrees.

15. The image-forming method according to claim 1, wherein the angle $\theta_1$ ranges from 15 to 75 degrees, and the angle $\theta_2$ ranges from 5 to 50 degrees.

16. The image-forming method according to claim 1, wherein the second magnetic blade is placed so that the line $L_4$ passing through the tip of the second magnetic blade perpendicularly to the vertical line $L_1$ and the second magnetic blade forms an angle $\theta_3$ ranging from 40° to 85°.

17. The image-forming method according to claim 16, wherein the angle $\theta_3$ ranges from 50 to 80 degrees.

18. The image-forming method according to claim 1, wherein the rotating member, the development sleeve, and the electrostatic image holding member are placed so that a ratio (Dab/Dac) of the gap Dab (gap $D_3$) between the rotating member and the development sleeve to a gap Dac between the rotating member and the electrostatic image holding member ranges from 0.005 to 0.8.

19. The image-forming method according to claim 18, wherein the ratio (Dab/Dac) ranges from 0.01 to 0.5.

20. The image-forming method according to claim 1, wherein the rotating member is rotated at a peripheral speed Ra, and the development sleeve is rotated at a peripheral speed of Rb, and a ratio (Ra/Rb) ranges from 0.90 to 2.00.

21. The image-forming method according to claim 20, wherein the ratio (Ra/Rb) ranges from 1.01 to 1.50.

22. The image-forming method according to claim 21, wherein the development sleeve is rotated at a peripheral speed ranging from 550 to 1000 mm/sec.

23. The image-forming method according to claim 21, wherein the development sleeve is rotated at a peripheral speed ranging from 600 to 900 mm/sec.

24. The image-forming method according to claim 20, wherein the development sleeve is rotated at a peripheral speed ranging from 550 to 1000 mm/sec.

25. The image-forming method according to claim 20, wherein the development sleeve is rotated at a peripheral speed ranging from 600 to 900 mm/sec.

26. The image-forming method according to claim 1, wherein a ratio (ra/rb) of an outside diameter ra of the rotating member to an outside diameter rb of the development sleeve ranges from 0.1 to 1.

27. The image-forming method according to claim 26, wherein the ratio (ra/rb) ranges from 0.2 to 0.8.

28. The image-forming method according to claim 1, wherein a ratio (Dab/Dae) of a gap Dab (gap $D_3$) between the rotating member and the development sleeve to a gap Dae (gap $D_1$) between the first magnetic blade and the rotating member ranges from 0.1 to 1.0.

29. The image-forming method according to claim 28, wherein the ratio (Dab/Dae) ranges from 0.2 to 0.8.

30. The image-forming method according to claim 1, wherein the magnetic toner contains fine powdery silica added externally thereto in an amount ranging from 0.01 to 8 parts by weight per 100 parts by weight of the toner particles.

31. The image-forming method according to claim 30, wherein the fine powdery silica has a length-average particle diameter ranging from 5 to 200 nm.

32. The image-forming method according to claim 30, wherein the fine powdery silica has a BET specific surface area ranging from 100 to 400 $m^2/g$.

33. The image-forming method according to claim 30, wherein the magnetic toner contains further a fine powdery metal oxide having a length-average diameter ranging from 0.3 to 3 $\mu$m added externally thereto in an amount ranging from 0.01 to 10 parts by weight per 100 parts by weight of the toner particles.

34. The image-forming method according to claim 33, wherein the magnetic toner contains the fine powdery metal oxide having a BET specific surface area ranging from 0.5 to 15 $m^2/g$ added externally thereto.

35. The image-forming method according to claim 33, wherein the fine powdery metal oxide is fine powdery strontium titanate, fine powdery calcium titanate, or fine powdery cerium oxide.

36. The image-forming method according to claim 1, wherein the magnetic toner contains fine powdery silica added externally thereto in an amount ranging from 0.1 to 5 parts by weight per 100 parts of the toner particles.

* * * * *